US006334975B1

(12) United States Patent
Yokote et al.

(10) Patent No.: US 6,334,975 B1
(45) Date of Patent: Jan. 1, 2002

(54) MOLTEN MAGNESIUM SUPPLY SYSTEM

(75) Inventors: Hironori Yokote, Ayase; Kazuhiro Suzuki, Yokohama; Yukio Katou, Kawasaki, all of (JP)

(73) Assignee: Toshiba Kikai Kabushiki Kaisha, Kawasaki (JP)

( * ) Notice: Subject to any disclaimer, the term of this patent is extended or adjusted under 35 U.S.C. 154(b) by 0 days.

(21) Appl. No.: 09/426,188

(22) Filed: Oct. 25, 1999

(30) Foreign Application Priority Data

Oct. 26, 1998 (JP) ..... 10-304501
Oct. 26, 1998 (JP) ..... 10-304502
Oct. 27, 1998 (JP) ..... 10-306050

(51) Int. Cl.[7] ..... C21D 11/00

(52) U.S. Cl. ..... 266/94; 164/155.2; 222/603; 266/237

(58) Field of Search ..... 266/94, 237; 222/603; 164/155.2

(56) References Cited

U.S. PATENT DOCUMENTS 5,700,422 A * 12/1997 Usui et al. ..... 266/94

FOREIGN PATENT DOCUMENTS

JP 3-37462 6/1991

* cited by examiner

*Primary Examiner*—Melvyn Andrews
(74) *Attorney, Agent, or Firm*—Finnegan, Henderson, Farabow, Garrett & Dunner, L.L.P.

(57) ABSTRACT

A molten metal transfer pipe 52 for transferring an injection sleeve 51 has a bent pipe portion 3 thereof reduced in diameter to provide a throttle part 4 attaining a pressure loss effect. A melting and holding furnace 101 with a tilting mechanism has a melting and holding furnace section 101 and an electrical lifter 113 for holding the melting and holding furnace section 101 horizontally and for tilting the melting and holding furnace 101 together with a molten metal supplying apparatus 102 upwardly about the melting chamber 104 serving as a tilting fulcrum C to hold the same in the tilted position. An ingot charging apparatus 201 includes a hood 208 mounted to a conveyor 205 for conveying each preheated magnesium ingot MA, which, at a discharge time of the preheated magnesium ingot MA and at a charge time of the same, communicates with an ingot discharge port 202*a* of a preheating apparatus 202 and an ingot charge port 203*a* of a melting and holding furnace 203*a* to define closed spaces 207 and 206 for allowing a discharge operation of the preheated magnesium ingot MA and a charge operation thereof, and which covers the preheated magnesium ingot MA held by an ingot chuck 204 during conveyance of the preheated magnesium ingot MA.

20 Claims, 11 Drawing Sheets

MOLTEN MAGNESIUM SUPPLY SYSTEM

BACKGROUND OF THE INVENTION

1. Field of the Invention

The present invention relates generally to a molten magnesium supply system as well as to a molten magnesium supply method, and in particular, to a molten magnesium supply system that is constituted with a molten magnesium supplying apparatus for a die casting machine of a cold chamber type for casting molten magnesium (with molten magnesium alloy inclusive), or includes a melting and holding furnace for melting a magnesium ingot and holding molten magnesium to be supplied to an injection sleeve of a die casting machine, or an ingot charging apparatus for charging a preheated magnesium ingot into a melting and holding furnace, as well as to a molten magnesium supply method that includes charging a preheated magnesium ingot into a melting and holding furnace, melting the ingot in the furnace, holding molten magnesium in the furnace, and supplying molten magnesium to an injection sleeve of a die casting machine.

2. Description of the Related Art

Cold-chamber die casting needs fresh and homogeneous molten metal to be continuously and instantaneously injected under high pressure into recesses of a cavity in a mold. For such injection, the die casting machine has an injection sleeve, and is provided with a supply system for supplying molten metal to the injection sleeve. The supply system is adapted for a conforming supply of molten metal meeting various requirements, such as for molten metal amount or quantity to be accurate and nature or quality to be controlled and stable in consideration of molding conditions.

In the case of magnesium, the molten metal has a significant tendency to be oxidized, and needs an air-free supply to the injection sleeve via pipe, duct, etc. For such supply, one may employ a molten metal transfer mechanism or molten metal transferring means for forcing molten metal to advance in a molten metal transfer pipe. The molten metal transfer mechanism or molten metal transferring means may be of a volume displacement type such as by use of a screw pump, or of a fluid streaming type such as by use of an electromagnetic pump in which a fluid flow rate is controlled with an electric current in an exciting coil around a fluid circuit.

A typical molten magnesium supply system is constituted with a molten magnesium supplying apparatus including a melting and holding furnace and sometimes provided with a preheater for preheating a magnesium ingot.

FIG. 1 illustrates a conventional molten metal supply system. The system comprises a furnace body Fb of a "magnesium melting and/or molten magnesium holding furnace (hereinafter sometimes called "molten metal furnace") 55 and a molten metal transfer pipe 52 extending therefrom. The transfer pipe 52 is constituted at a suction inlet end thereof with an outlet port Fp of the furnace 55 communicating with an inside of the furnace body Fb, and along the remaining length thereof with a heated transfer tube Tb flange-joined to the port Fp. An electromagnetic pump 50 is installed on the inlet end of the pipe 52. The transfer pipe 52 is formed at a delivery end thereof with a downwardly bent portion 52*a*, which has a downward opening 52*b* as a supply outlet matching in position with an upward reception opening 51*a* of an injection sleeve 51.

Molten magnesium M in the molten metal furnace 55 receives a constant leveling, whereby a "surface level of molten magnesium" (hereinafter called "melt level" or simply "level") B in the furnace 55 is controlled so that a melt level A in the transfer pipe 52, which is equivalent to the level B, is maintained near "a height of a bottom point of an inner circumference at a top of tube wall" (hereinafter sometimes called "delivery height" or simply "height") of the delivery end portion 52*a*.

In the above-noted system, molten magnesium M flowing in the pipe 52 is subjected to a flow resistance at both suction and delivery sides of the electromagnetic pump 50. The flow resistance of pipe 52 is small, but increases with foreign materials sticking on the wall or mixed in metal. In this case, if the coil current of the pump 50 is constant, the pump 50 delivers a reduced amount of molten metal.

To keep the delivery rate free from unfavorable influences of conditions in the transfer pipe 52, a throttle 53 is installed at a flange joint portion 52*d* of the pipe 52, and fixed thereto. The throttle 53 provides a sufficient flow resistance for the pump 50 to deliver a corresponding flow rate of molten metal, allowing for the transfer pipe 52 to supply the flow rate of molten metal.

Accordingly, in this molten metal supply system empolying an electromagnetic pump, a metering accuracy of molten metal can be maintained high by exchanging the fixed throttle 53 to another one or cleaning the same.

In order to prevent molten magnesium M from being oxidized, an injection opening 52*c* for injecting anti-oxidization gas G for the molten magnesium M is provided at a top portion of the delivery end portion 52*a*. Anti-oxidization gas G injected from the injection opening 52*c* is filled in a space defined by molten metal of the melt level A and the wall of to the delivery end portion 52*a* of the transfer pipe 52, so that molten metal M to be supplied to the injection sleeve 51 is prevented from oxidization. The anti-oxidization gas G is also injected in the molten metal furnace 55, and a space above the melt level B in the furnace 55 is filled with the gas G.

As the anti-oxidization gas G, there is used a diluted antideflagrant gas in which sulfur hexafluoride (hereinafter referred to as "$SF_6$") is diluted with dried air, or an inert gas such as argon.

In FIG. 1, reference numeral 54 denotes a heater, reference numeral 57 denotes an injection plunger driven in a reciprocating manner within the injection sleeve 51 by a hydraulic operation mechanism 58, and reference numeral 59 denotes a metal mold cavity communicating with the injection sleeve 51.

In the conventional molten metal supply system empolying an electromagnetic pump, however, as the throttle 53 is fixed to the flange joint portion 52*d* of the transfer pipe 52, there occur needs of pipe disconnection for maintenance services, such as for cleaning to the throttle 53 or pipe wall therearound or for replacement of the throttle 53. In particular, in the case of molten magnesium (including molten magnesium alloy), the molten metal tends to be oxidized or combusted during such a service.

Though one of $SF_6$ dilute antideflagrant gas and an inert gas such as argon is generally used as anti-oxidization gas G, such a use of single gas has a potential possibility of causing molten metal oxidization or loose ending or cut of molten metal supply. There is a problem of increased oxidization, followed by difficulty in maintenance work, and a supply amount of molten metal becomes unstable, so that a stable die casting work can not be performed.

That is, $SF_6$ dilute antideflagrant gas is relatively inexpensive and has a high antideflagrant effect owing to a high dilution rate thereof. However, when molten magnesium M is transferred to the injection sleeve 51 by the electromagnetic pump 50, oxidization of the molten magnesium M and/or reaction product is easy to occur and the ending of molten magnesium supply at the opening 52*b* of the delivery end portion 52*a* becomes sharp.

An inert gas such as argon is used alone, which becomes relatively expensive, however, oxidization of the molten magnesium M is reduced and the ending of molten magnesium supply is improved. In an ordinary use, however, the antideflagrant nature is relatively inferior, and there is a problem that, when the melt level M in the molten metal furnace 55 varies at an ON/OFF time of the constant melt level control and external air enters in/leaves from the molten metal furnace 55, the molten magnesium M sticking on an inner surface of the delivery end portion 52*a* is oxidized.

Furthermore, in the conventional molten metal supply system empolying an electromagnetic pump, as the delivery end portion 52*a* of the transfer pipe 52 is bent downwards, delivered molten magnesium M falls into the injection sleeve 51, where it has turbulent streams. Turbulent streams accompany air inclusion into molten metal M, causing oxidization and combustion of molten magnesium M, with an increased quantity of reaction products such as oxides, constituting a difficulty of maintenance, rendering supply molten metal amount unstable. As a result, a stable die casting work can not be obtained.

Also, in a conventional melting and holding furnace, a crucible having a bath tab shape is partitioned into a melting chamber and a holding chamber by a partition plate. In this case, the melting chamber is cold-charged (ingot is thrown and melted in the melting chamber) and molten magnesium is transferred to the holding chamber via the partition plate. A transfer pipe is provided downward of the holding chamber, and molten magnesium is filled in the transfer pipe.

In Japanese Patent Publication No. 3-37462, there has been disclosed a temperature holding furnace provide with a transfer pipe for supplying molten metal to an injection sleeve in a die casting machine. The temperature holding furnace has a structure in which molten metal is hot-charged from another melting furnace, and the furnace itself is maintained horizontally during die casting work and it is maintained together with the transfer pipe in its tilted position during stopping of die casting work.

In these cases, when the molten metal to be applied is magnesium alloy, as it has a tendency to rapidly produce oxide with air in contact, oxidization of the metal can be suppressed in a state in which a space in the transfer pipe is filled with antideflagrant gas, which results in improvement in quality of die cast product.

In the latter temperature holding furnace, molten metal in the transfer pipe can be transferred by holding the temperature holding furnace as well as the transfer pipe in the tilted position so that easiness in such a work as maintenance can be achieved. In the conventional melting and holding furnace or temperature holding furnace, however, when a cold charge or a hot charge is conducted, disturbance occurs in molten magnesium portion around charged portion, air is involved in molten magnesium due to this disturbance, and the molten magnesium is oxidized, so that much dross/sludge occurs due to this oxidization. There is a drawback that, since molten magnesium including this dross/sludge is transferred to the transfer pipe portion via the holding chamber, which results in troubles inside the transfer pipe and/or bad quality products.

Also, in the conventional melting and holding furnace, as the transfer pipe is fixed in a horizontal position, when it is required to discharge molten magnesium contained in the transfer pipe at a time of maintenance or the like, it is not only made impossible to discharge molten magnesium remaining in the transfer pipe completely but also it is required to handle some molten magnesium sufficiently carefully, which results in difficulty in maintenance work.

Furthermore, in the melting and holding furnace, as one crucible serves as the melting chamber and the holding chamber, there are two cases, namely cold charge is being effected in the melting chamber side and it is not being effected. Due to these two cases, there occurs a drawback that, when the temperature of the molten magnesium in the holding chamber is controlled, it becomes difficult to maintain molten magnesium in the holding chamber in a constant temperature without temperature variation, and fluidic characteristic of molten magnesium varies due to temperature variation so that supply amount of molten magnesium is made unstable and, therefore, die cast products of a good quality can not be secured in a stable manner.

A first conventional method or a second conventional method is employed for charging a magnesium ingot to a melting and holding furnace. In the first conventional method, a rack for preheating is placed on a melting and holding furnace and a magnesium ingot is manually thrown into molten magnesium. In the second conventional method, when a preheated magnesium ingot placed with a lying position in which its longitudinal axis is horizontal is automatically charged from a preheating apparatus to a melting and holding furnace, it is pushed on such guide means as a rolling type conveyor and thrown by a cylinder so as to fall in the melting and holding furnace.

In the first conventional method, a degree of freedom for throwing is high to some extent, but first a worker is always required therefor and secondly a furnace lid can not be put in an opened state for a long time in view of radiation heat from the melting and holding furnace and/or oxidization of molten magnesium.

In the second conventional method, as an ingot falls in molten magnesium with nonstop, a molten magnesium melt level and antideflagrant gas atmosphere are disturbed.

In the first and second conventional methods, thus, generation of dross/sludge is increased due to the disturbances of the molten magnesium melt level and the antideflagrant gas atmosphere, so that a problem or defect occurs in the quality of die cast products obtained.

When the furnace lid is opened for a long time, the temperature of molten magnesium is lowered and, when die casting is performed in a die casting machine, fluidity of molten magnesium deteriorates and varies due to the temperature lowering. As a result, a problem or defect occurs in the quality of die cast products.

Furthermore, a variation of melt level corresponding to one magnesium ingot and acceleration of vertical movement of melt surface due to falling of a magnesium ingot with nonstop acts as dynamic pressure variation in a molten metal transfer pipe, for example, in a molten magnesium supply system employing an electromagnetic pump. There are also a drawback in which the dynamic pressure in the transfer pipe adversely affects metering accuracy for the delivery amount of molten magnesium.

A first object of the present invention is to provide a molten magnesium supply system including a molten magnesium supplying apparatus which has an excellent easiness in maintenance work or in which the supply amount of molten magnesium is made stable so that a stable die casting work can be obtained.

A second object of the invention is to provide a molten magnesium supply system including a melting and holding furnace with a tilting mechanism in which maintenance work can be made easy and dross/sludge occurring in a melting chamber can be effectively prevented from moving to a holding chamber, and temperature of molten magnesium in the holding chamber can be controlled with a high accuracy, so that die cast products of a good quality can be obtained in a stable manner.

A third object of the invention is to provide a molten magnesium supply system including an ingot charging apparatus, and a molten magnesium supply method in which automatic charge of a magnesium ingot is allowed in a state in which oxidization of molten magnesium, temperature lowering of the molten magnesium and melt level variation are suppressed to the utmost, thereby improving and stabilizing the quality of die cast product.

SUMMARY OF THE INVENTION

The present invention has been made with such points in view.

To achieve objects, an aspect of the present invention provides a molten magnesium supply system including a molten metal furnace put under a melt level control, a molten magnesium supplying apparatus comprising a molten metal transfer pipe communicating at one end thereof with the molten metal furnace, the molten metal transfer pipe having at another end thereof an ascending bent pipe portion as a deliver) portion for delivery of molten magnesium to be supplied to an injection sleeve, and molten metal transferring means for forcing molten magnesium from the molten metal furnace to be transferred in the molten metal transfer pipe and delivered through the delivery portion, and gas supplying means for supplying an anti-oxidization gas to vacant spaces in the molten metal furnace and the molten metal transfer pipe, wherein the molten metal transfer pipe is provided with a funnel portion communicating with the delivery portion, for receiving delivered molten magnesium from the delivery portion and supplying received molten magnesium to the injection sleeve.

According to this aspect, a melt level of molten magnesium in a molten metal transfer pipe is maintained at a delivery height of a bent pipe portion close to a funnel portion according to a melt level control in a molten metal furnace. Molten magnesium is delivered from a delivery portion of the molten metal transfer pipe to the funnel portion, as it is forced to be transferred by molten metal transferring means, and delivered molten magnesium is wholly supplied to an injection sleeve.

In a molten magnesium supply system according to any applicable aspect herein, the bent pipe portion may preferably be reduced to have a throttle part.

In a molten magnesium supply system according to any applicable aspect herein, the funnel portion may preferably comprise a communication part for communication with the bent pipe portion, a supply hole for supplying received molten magnesium to the injection sleeve, and a lower part extending between the communication part and the supply hole, the lower part having an inside surface gradually reduced in diameter and smoothly bent between the communication part and the supply hole.

In this case, a melt level of molten magnesium in a molten metal transfer pipe is maintained at a delivery height of a bent pipe portion according to constant melt level control in a molten metal furnace, close to a funnel portion. Molten magnesium is delivered from a delivery end of the molten metal transfer pipe to the funnel portion by molten metal transferring means and the whole delivered amount of molten magnesium is supplied to an injection sleeve.

Since supplying molten magnesium to the injection sleeve is performed from the melt level of molten magnesium close to a supply hole of the funnel portion, a flowing-out head of the molten magnesium can be made small. Since the inside surface of a lower part of the funnel portion is gradually reduced in inside diameter and bent smoothly, it is formed in a smooth flowing-out sloped surface and molten magnesium is supplied to the injection sleeve in a turbulence-reduced state. Accordingly, oxidization of the molten magnesium and reaction product therewith are prevented from occurring at the supply end and troubles such as combustion, blocking, staying, and the like due to such an occurrence are also prevented, so that molten metal supply to the injection sleeve can be sharply ended. Thus, the molten magnesium supplying apparatus has an excellent easiness in maintenance work, and a supply amount of molten magnesium is made stable so that a stable die casting work can be performed.

In a molten magnesium supply system according to any applicable aspect herein, the supply hole of the funnel portion may preferably be provided with a shutter for closing the supply hole.

In this case, the shutter can block a residue drip from the supply hole.

In a molten magnesium supply system according to any applicable aspect herein, the funnel portion may preferably be formed with an upper opening and provided with a lid for closing the upper opening.

In this case, the lid can be attached to or detached from an upper opening of the funnel portion, permitting a facilitated maintenance and cleaning to the funnel portion, allowing an improved maintenance service and a stable supply of molten magnesium.

In a molten magnesium supply system according to any applicable aspect herein, the gas supply means may preferably comprise a first gas supply line for supplying an inert gas as the anti-oxidization gas, a second gas supply line for supplying a sulfur hexafluoride dilute antideflagrant gas as the anti-oxidization gas, and control means for supplying a vacant space of the funnel portion with the inert gas when the melt level control to the molten metal furnace is on, and with the sulfur hexafluoride dilute antideflagrant gas when the melt level control is off.

In this case, a melt level of molten magnesium within a molten metal transfer pipe is maintained at a delivery height of a bent pipe portion and close to a funnel portion. An amount of molten magnesium is transferred by the molten metal transferring means, and is delivered from the delivery portion of the molten metal transfer pipe to the funnel portion so that delivered molten magnesium is wholly supplied to an injection sleeve.

When the melt level control to the molten metal furnace is turned on, an inert gas is filled in a vacant space of the funnel portion, whereby the delivered molten magnesium is kept from oxidization and in free of reaction products due to such oxidization, thus allowing the ending of molten magnesium supply to be quick and sharp, so that supply of molten magnesium to the injection sleeve is rendered stable.

When the melt level control is turned off at the molten metal furnace, a sulfur hexafluoride dilute antideflagrant gas is filled in a vacant space that the funnel portion then has, so that oxidization and combustion of molten magnesium is prevented over an off-duty period of molten magnesium supply, and molten magnesium left in the transfer pipe is kept free from magnesium oxides that otherwise might have been produced by such oxidization or combustion. Such oxides would have adhered to or deposited on the wall of the transfer pipe. As a result, molten magnesium supply is allowed to be ended sharp. Maintenance to the system is facilitated. A necessary supply amount of molten magnesium is secured, ensuring a conforming die casting.

In a molten magnesium supply system according to any applicable aspect herein, the control means may preferably comprise a control valve operative with a control command for the melt level control.

In this case, switching-over of gases to be supplied can be automatically controlled with a control command for melt level control, allowing a more excellent easiness in maintenance work and a more stable supply of molten magnesium.

In a molten magnesium supply system according to any applicable aspect herein, the molten metal transferring means may preferably comprise a volume replacement transfer mechanism.

In this case, a desirable amount of molten magnesium can be secured in transfer.

In a molten magnesium supply system according to any applicable aspect herein, the molten metal transferring means may preferably comprise a fluid streaming transfer mechanism.

In this case, a controlled amount of molten magnesium can be transferred in a flexible manner.

In a molten magnesium supply system according to any applicable aspect herein, the fluid streaming transfer mechanism may preferably comprise an electromagnetic pump.

In this case, molten magnesium is transferred along the transfer pipe by the electromagnetic pump, which may be automatically controlled in synchronism with the melt level control of the molten metal furnace.

In a molten magnesium supply system according to any applicable aspect herein, the molten metal furnace may preferably comprise a melting and holding furnace including a crucible member provided with a melting chamber heated for melting magnesium and a holding chamber heated for holding molten magnesium, the melting chamber communicating with the holding chamber at a bottom region of the crucible member deeper in the melting chamber than in the holding chamber, the holding chamber communicating with the one end of the molten metal transfer pipe.

In this case, a cold-charged magnesium block may be melted in a melting chamber. Streams of heavier molten magnesium tend to be stagnant at a bottom of the melting chamber, where they are advantageously kept from flowing through a holding chamber into the molten metal transfer pipe.

In a molten magnesium supply system according to any applicable aspect herein, the melting and holding furnace may preferably include a tilting mechanism for tilting the crucible member together with the molten metal transfer pipe.

In this case, the transfer pipe can be tilted relative to a melt level to expel molten magnesium, as necessary for maintenance service.

In a molten magnesium supply system according to any applicable aspect herein, the melting chamber may preferably have a round bottom, and the holding chamber may preferably have a flat bottom.

In this case, insufficiently heated molten magnesium has an increased stagnant tendency in a round bottom, and sufficiently heated molten magnesium has an increased flowing tendency on a flat bottom.

In a molten magnesium supply system according to any applicable aspect herein, the melting and holding furnace may preferably include a gas burner for heating the melting chamber and an electric heater for heating the holding chamber.

In a molten magnesium supply system according to any applicable aspect herein, the molten metal furnace may preferably comprise a melting and holding furnace for melting a preheated magnesium ingot and holding molten magnesium, and the molten magnesium supply system may preferably comprise ingot charging means for charging the preheated magnesium ingot into the melting and holding furnace, keeping the preheated magnesium ingot substantially free from contact with air.

In this case, a preheated magnesium ingot can be charged into a melting and holding furnace, without unfavorable contact with air, allowing for molten magnesium of a secured quality to be supplied.

In a molten magnesium supply system according to any applicable aspect herein, the molten magnesium supply system may preferably comprise a preheater for preheating a magnesium ingot to provide the preheated magnesium ingot in an oxidant-free atmosphere, and the ingot charging means may preferably be adapted for discharging the preheated magnesium ingot from the prehater, keeping the preheated magnesium ingot substantially free from contact with air.

In this case, a preheated magnesium ingot can be discharged from a preheater, without unfavorable contact with air, allowing for the ingot to be handled in a fresh state.

In a molten magnesium supply system according to any applicable aspect herein, the ingot charging means may preferably be adapted for carrying the preheated magnesium ingot between the preheater and the melting and holding furnace, keeping the preheated magnesium ingot substantially free from contact with air.

In this case, a preheated magnesium ingot can be carried between the preheater and the melting and holding furnace, without unfavorable contact with air, allowing for the ingot to be charged in a fresh state.

In a molten magnesium supply system according to any applicable aspect herein, the ingot charging means may preferably comprise a chuck for chucking the preheated magnesium ingot, a carrier for carrying the chuck, a hood for covering the chuck and the preheated magnesium ingot, and gas supply means for supplying an anti-oxidization gas inside the hood.

In this case, supplied anti-oxidization gas protects a preheated magnesium ingot from unfavorable contact with ambient air about a hood.

Further, to achieve the first aspect, another aspect of the invention provides a molten magnesium supply system including a molten metal furnace put under a melt level control, a molten magnesium supplying apparatus comprising a molten metal transfer pipe communicating at one end thereof with the molten metal furnace, the molten metal transfer pipe having at another end thereof an ascending bent pipe portion as a delivery portion for delivery of molten magnesium to be supplied to an injection sleeve, and molten metal transferring means for forcing molten magnesium from the molten metal furnace to be transferred in the molten metal transfer pipe and delivered through the delivery portion, and gas supplying means for supplying an anti-oxidization gas to vacant spaces in the molten metal furnace and the molten metal transfer pipe, wherein the bent pipe portion is reduced to have a throttle part.

According to this aspect, upon delivery of molten magnesium from a delivery portion that is an ascending bent pipe portion of a molten metal transfer pipe, molten magnesium flowing in bent pipe portion is subjected to a flow resistance of a throttle part, having a head loss developed thereacross. As the flow resistance can be set in a voluntary manner, the head loss can be large enough to substantially control delivery rate of molten magnesium without employing a conventional throttle fixed to a flange joint portion at a suction end.

To achieve the second object, another aspect of the invention provides a molten magnesium supply system including a melting and holding furnace with a tilting mechanism comprising a melting and holding furnace section constituted with a crucible whose interior is partitioned to a holding chamber and a melting chamber by a partition portion such that molten magnesium is mutually movable between the holding chamber and the melting chamber, the bottom portion of the melting chamber being lower than the bottom portion of the holding chamber, and heating means being respectively provided for heating the holding chamber and the melting chamber exclusively, a molten metal supplying apparatus provided so as to communicate with the holding chamber, for supplying molten magnesium into an injection sleeve of a die casting machine, and a tilting mechanism for holding the melting and holding furnace section horizontally and for, as occasion demands, tilting the melting and holding furnace section together with the molten metal supplying apparatus upwardly about the melting chamber serving as a tilting fulcrum to hold the same in the tilted position.

According to this aspect, dross/sludge generated in a melting furnace and/or molten magnesium with a relatively high specific gravity which has just been cold-charged to melt down are deposited or stayed on a bottom of the melting chamber due to a difference in height between a bottom portion of a holding chamber and the bottom portion of the melting chamber and they can be prevented from moving the holding chamber.

Also, respective temperature controls of molten magnesium respectively contained in the holding chamber and the melting chamber can be performed by respective exclusive heating means regardless of temperatures of the molten magnesium in the respective adjacent chambers. Accordingly, the temperature control of molten magnesium in the holding chamber can be performed with a high accuracy by the exclusive heating means regardless of absence/existence of cold-charge, and die cast products a good quality of can be obtained in a stable manner.

When the melting and holding furnace section is tilted together with a molten metal supplying apparatus to be held in the tilted position, molten magnesium in the molten metal supplying apparatus can be delivered to a crucible without staying. Accordingly, easiness in maintenance work can be obtained.

In a molten magnesium supply system according to the above aspect, the holding chamber may preferably be formed at the bottom portion thereof in an approximate flat bottom, the melting chamber may preferably be extended from the approximate flat bottom and formed in a downwardly concave round bottom, and the heating means may preferably be constituted with an electric heater for the holding chamber and a gas burner for the melting chamber.

In this case, dross/sludge generated in a melting chamber and/or molten magnesium with a relatively high specific gravity, as it has just been molten from a cold-charged block, are stayed or deposited in a round bottom of a melting chamber owing to a difference in shape between a bottom of a holding chamber and the melting chamber, so that they are kept from being carried into the holding chamber.

Temperature of molten magnesium in the holding chamber can be controlled with a high accuracy by a readily controllable electric heater, and magnesium ingot charged to the melting chamber can melt in a short while with an efficient hot heating of the round bottom by a gas burner. Accordingly, die cast products can be obtained with a secured quality.

As the bottom of the melting chamber is shaped in a round form, melting work in which supply of molten magnesium is not performed can be effected with a position of the melting and holding furnace held in an inclination state, so that dross/sludge generated during melting work and molten magnesium having a relatively high specific gravity which has just been melted down can almost completely be prevented from being transferring to the holding chamber. Accordingly, troubles which may occur in an interior of a molten metal supplying apparatus are suppressed so that maintenance work can be facilitated and die cast products of a good quality can be obtained in a more stable manner.

To achieve the third object, another aspect of the invention provides a molten magnesium supply system including an ingot charging apparatus for charging a preheated ingot from a preheating apparatus to a melting and holding furnace, the system comprising conveying means for holding the preheated magnesium ingot by an ingot chuck to discharge the same from the preheating apparatus and for conveying the discharged magnesium ingot to charge the same into the melting and holding furnace, and a hood mounted to the conveying means, which communicates with an ingot discharge port of the preheating apparatus and an ingot charge port of the melting and holding furnace respectively at an ingot discharge time and at an ingot charge time of the preheated magnesium ingot to form closed spaces for allowing ingot discharge operation of the ingot chuck and allowing charge operation thereof, and which covers the preheated magnesium ingot held by the ingot chuck during conveyance.

According to this aspect, a preheated ingot can be charged from a preheating apparatus to a melting and holding furnace by conveying means without manual operation.

As discharge of the preheated ingot from the preheating apparatus and charge thereof to the melting and holding furnace are performed by an ingot chuck operated within closed spaces defined by a hood, immersion of air, disturbance or flowing-out of antideflagrant gas in the melting and holding furnace and heat dissipation form the melting and holding furnace can be suppressed.

As the preheated magnesium ingot is covered with the hood during conveyance from the preheating apparatus to the melting and holding furnace, heat dissipation from the magnesium ingot is suppressed and temperature lowering of the ingot itself can be suppressed to the utmost. By the provision of an ingot charging apparatus, a preheated magnesium ingot can automatically be charged to the melting and holding furnace, so that oxidization of molten magnesium, temperature lowering of the molten magnesium, and variation in molten surface are suppressed to the utmost. As a result, the ingot charging apparatus contributes to an improvement in quality of die cast products, allowing for a secured quality.

In a molten magnesium supply system according to the above aspect, the hood may preferably have a gas injection port for antideflagrant gas.

In this case, charge of a preheated magnesium ingot to a melting and holding furnace can be carried out while antideflagrant gas is injected into a closed space defined by a hood. Oxidization of molten magnesium is suppressed by injection of the antideflagrant gas, allowing a decrease in charge speed of the ingot. Corresponding to the decrease, variations in molten magnesium temperature and/or disturbances of molten magnesium melt level and of antideflagrant gas atmosphere can be suppressed. Accordingly, die cast products can be improved with a secured quality.

To achieve the third object, another aspect of the invention provides a molten magnesium supply method including charging a preheated magnesium ingot by using an ingot charging apparatus according to the above aspect, wherein the preheated magnesium ingot is held by the ingot chuck in a longitudinal position where its longitudinal axis is vertical to be discharged from the preheating apparatus by the conveying means and to be conveyed to the melting and holding furnace, and, after most portion of the magnesium ingot is immersed in molten magnesium in the melting and holding furnace by a vertical downward operation of the ingot chuck at a low speed in a state in which the closed space defined by the hood communicating with the ingot charge port of the melting and holding furnace is filled with the antideflagrant gas injected from the gas injection port, the magnesium ingot is released into the melting and holding furnace.

According to this aspect, as a preheated magnesium ingot can enter in a melting and holding furnace from an ingot charge port in a longitudinal position where its longitudinal axis is vertical, the ingot charge port can be set such that its opening area is small, and correspondingly heat dissipation from the melting and holding furnace can be suppressed.

Immersion of the preheated magnesium ingot to molten magnesium is carried out by vertical downward operation of an ingot chuck at a low speed in a state in which a closed space is filled with antideflagrant gas, namely the immersion can be performed in a state in which oxidization of molten magnesium, variation in molten magnesium temperature, and disturbances of a molten magnesium melt level and a antideflagrant gas atmosphere are suppressed. Accordingly, an ingot charging method can be provided to improve and stabilize quality of die cast products.

Another aspect of the invention provides a molten magnesium supply method comprising the steps of chucking a preheated magnesium ingot in a suspended position, keeping the chucked magnesium ingot free from contact with air, charging the chucked magnesium ingot into a crucible communicating with a molten metal transfer pipe and controlled for a melt level of molten magnesium therein, transferring molten magnesium to be delivered from the crucible through the transfer pipe and supplied to an injection sleeve before a shot of supplied molten magnesium for a die casting, lowering the chucked magnesium ingot to be partially dipped and melted in molten magnesium in the crucible, as the melt level is lowered, repeating the transferring molten magnesium, repeating the lowering the chucked magnesium ingot, and releasing the dipped magnesium ingot into molten magnesium in the crucible.

According to this aspect, a melt level can be controlled in a facilitated manner.

BRIEF DESCRIPTION OF THE DRAWINGS

The above and further objects and novel features of the present invention will more fully appear from the following detailed description when the same is read in conjoint with the accompanying drawings, in which.

DETAILED DESCRIPTION OF THE PREFERRED EMBODIMENTS

Figure 1:
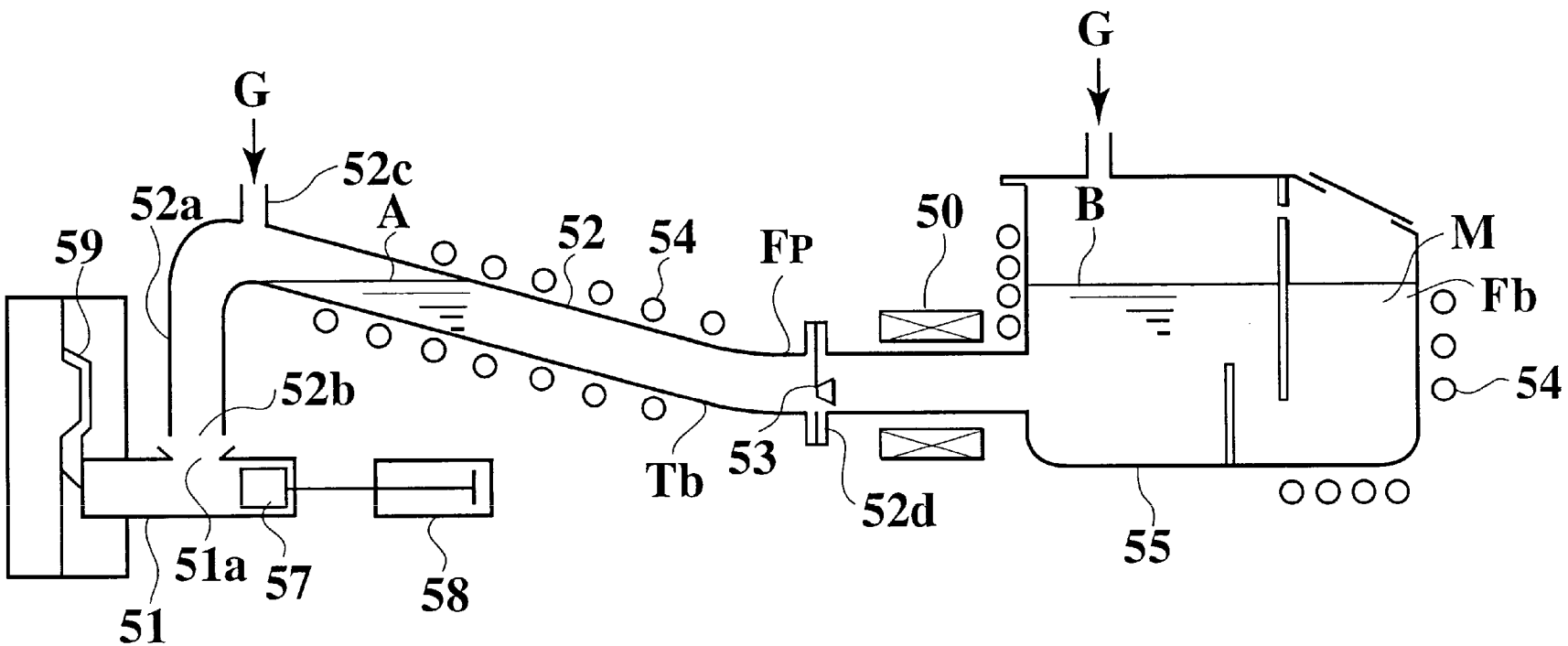
FIG.1 PRIOR ART
FIG. 1 is a schematic explanatory view illustrating an entire structure of a conventional molten metal supply system empolying an electromagnetic pump.

There will be detailed below the preferred embodiments of the present invention with reference to the accompanying drawings. Like members are designated by like reference characters.

Figure 2:
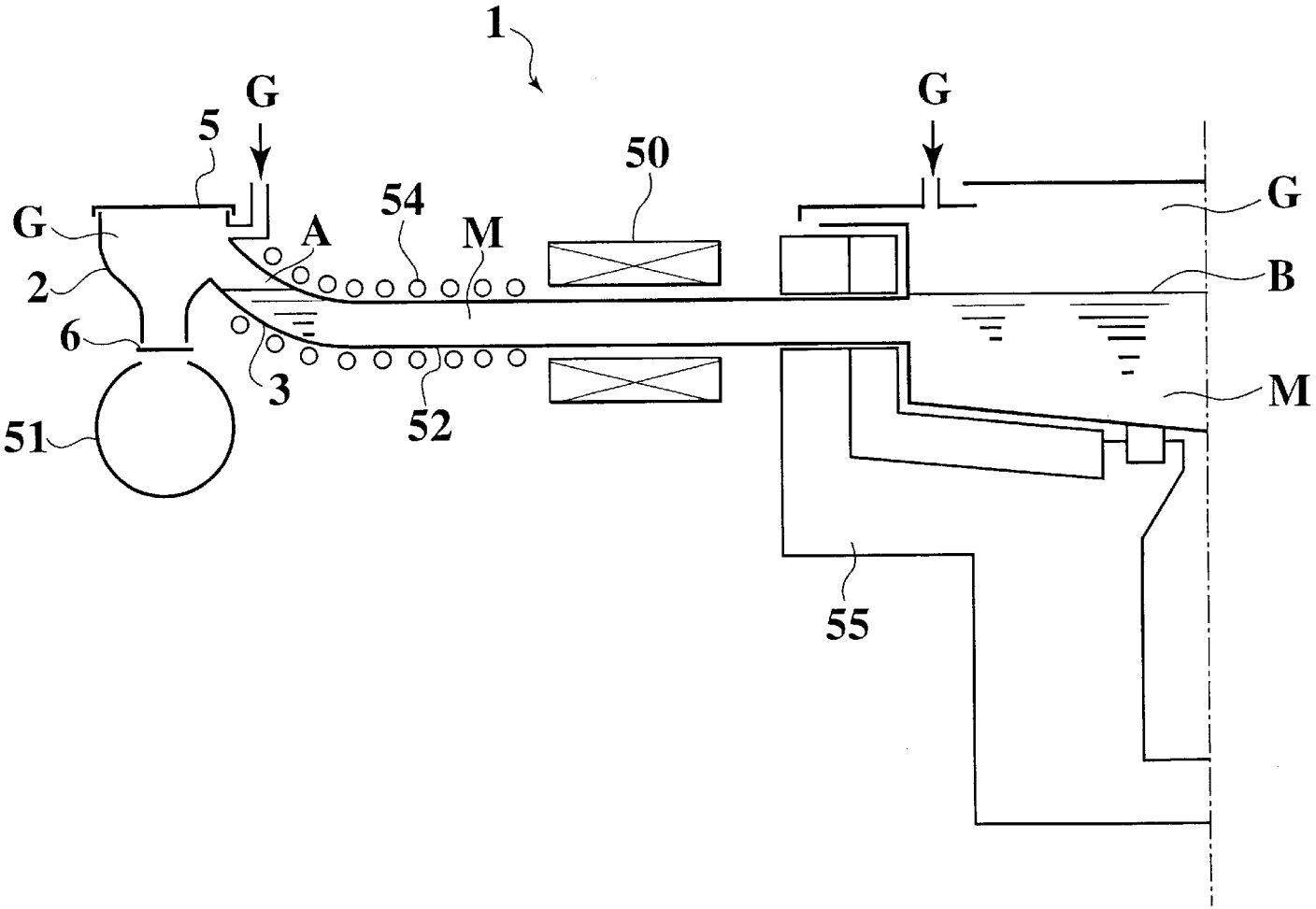
FIG. 2 is a schematic explanatory view illustrating an entire structure of a molten magnesium supplying apparatus for embodiments of the present invention.

FIG. 2 is a schematic explanatory view illustrating a schematic entire configuration of a molten magnesium supplying apparatus I according to an embodiment of the invention. The molten magnesium supplying apparatus 1 is applied to a cold chamber die casting machine which effects die casting for molten magnesium (including magnesium alloy). The apparatus 1 includes an electromagnetic pump 50 serving as molten metal transferring means, and a suction side of the electromagnetic pump 50 communicates with a molten metal furnace 55 subjected to constant melt level control while a molten metal transfer pipe 52 formed at its delivery side in a bent pipe portion 3 bent upward and communicating with a funnel portion 2 is provided at a delivery side of the pump 50. In a state in which anti-oxidization gas G is filled in the funnel portion 2, the electromagnetic pump 50 is driven to supply molten magnesium M within the molten metal furnace 55 into an injection sleeve 51 through the molten metal transfer pipe 52 and the funnel portion 2. The molten magnesium supplying apparatus 1 is structured as mentioned above.

In this time, anti-oxidization gas G is also injected into the molten metal furnace 55, and molten magnesium M in the molten metal furnace 55 is prevented from being oxidized.

The bent pipe portion 3 has a structure in which its distal end portion is bent in a standing manner at an angle of about 45 degrees from a horizontal direction obliquely and upwardly and an upper end thereof is connected to the funnel portion 2, and a heater 54 is disposed of outside the bent pipe portion 3. The bent pipe portion 3 can be heated by the heater 54 so as to be kept at a constant temperature.

A melt level A of molten magnesium in the molten metal furnace 52 is maintained at a delivery height of the bent pipe portion 3 and close to the funnel portion 2.

Molten magnesium transferred by the electromagnetic pump 50 is delivered from a delivery end of the molten metal transfer pipe 52 to the funnel portion 2 and the total amount of the molten magnesium delivered is supplied to the injection sleeve 51. At this time, since the electromagnetic pump 50 is employed as the molten metal transferring means, transferring of molten magnesium M performed by driving of the electromagnetic pump 50 can be automatically controlled in an interlocking manner with constant melt level control and supply of anti-oxidization gas G.

Incidentally, in the molten magnesium supplying apparatus 1, pumping drive of the electromagnetic pump 50 is interlocked with the constant melt level control. Delivery operation of molten magnesium M is performed during the constant melt level control to effect operation of the die casting machine and to produce a product, while molten magnesium M is returned back to the molten metal furnace 55 and operation of the die casting machine and production of a product are stopped during a constant melt level non-control state in which the constant melt level control is out of duty.

Figure 3:
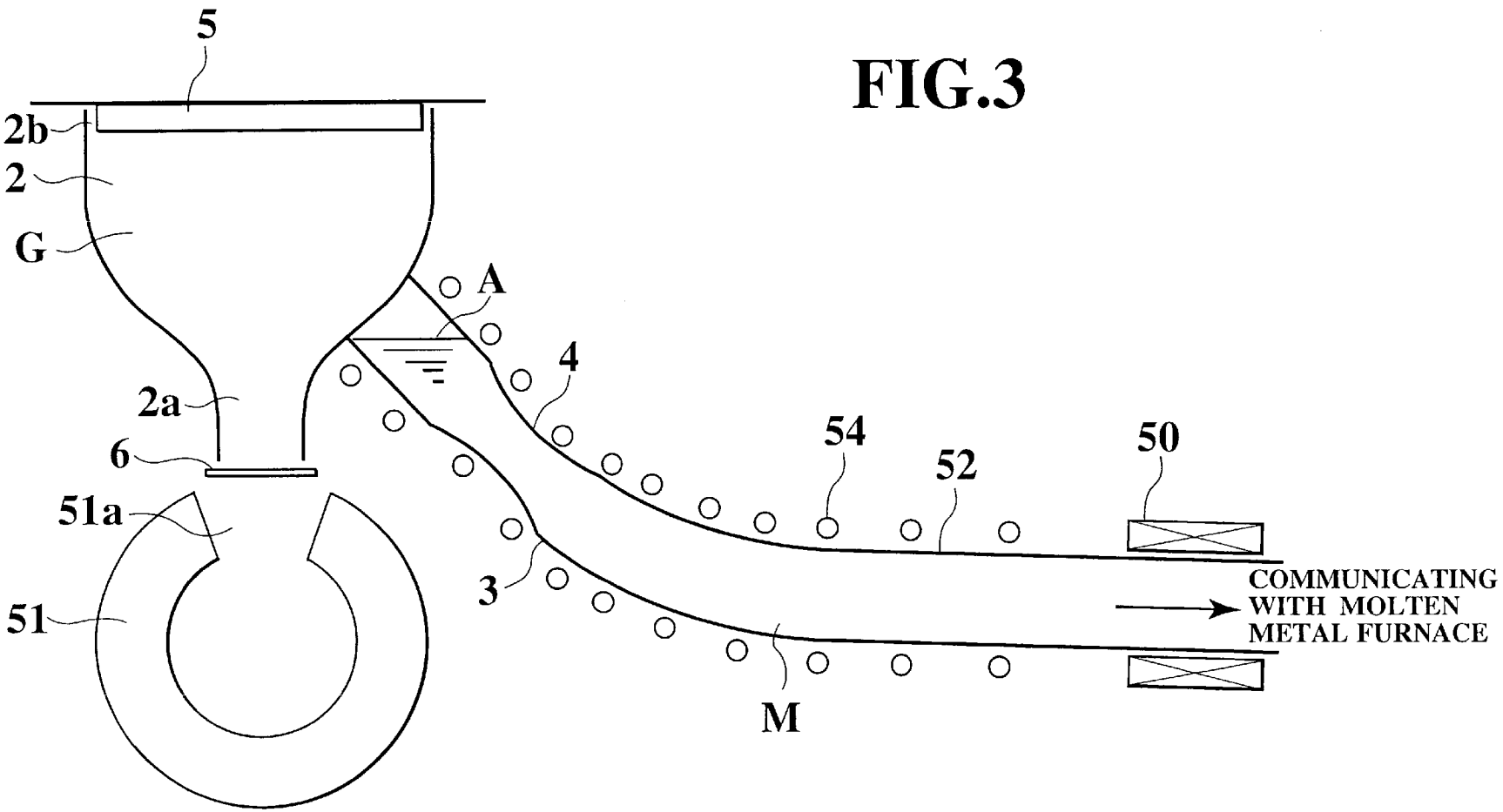
FIG. 3 is a schematic explanatory view illustrating a portion of the molten magnesium supplying apparatus according to a first embodiment of the invention.
Figure 4:
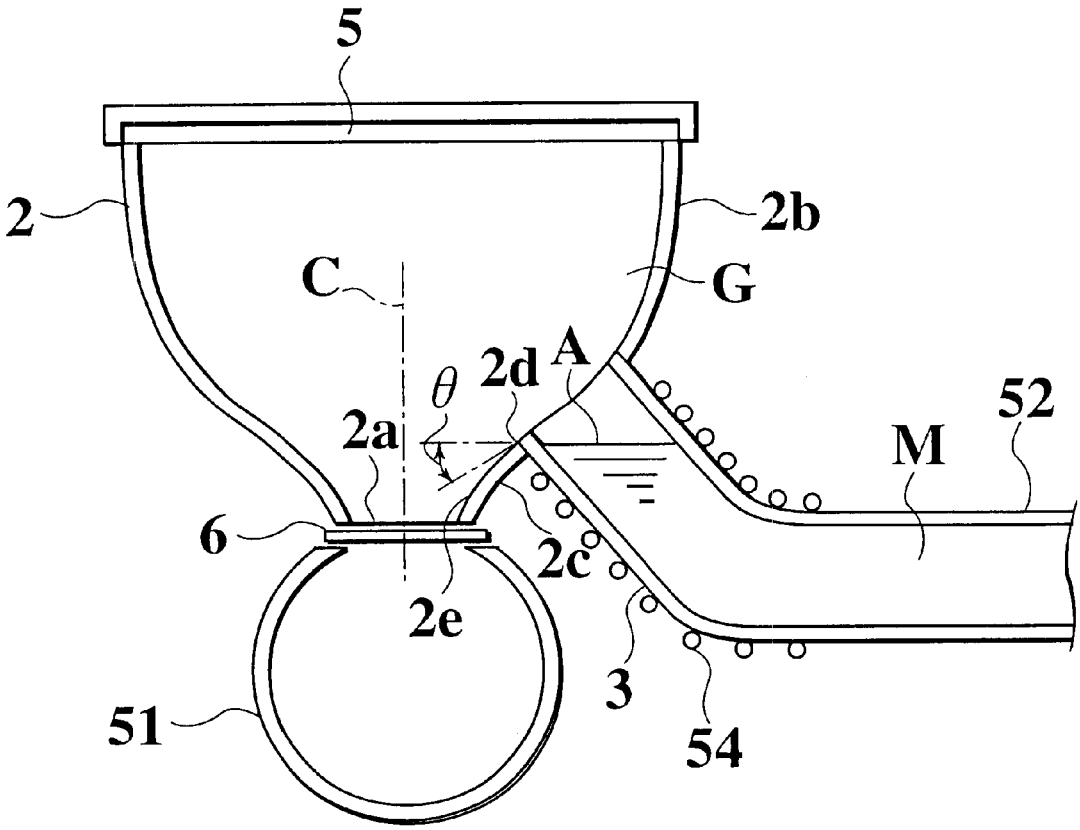
FIG. 4 is a schematic explanatory view illustrating a portion of a molten magnesium supplying apparatus according to a second embodiment of the invention.
Figure 5A:
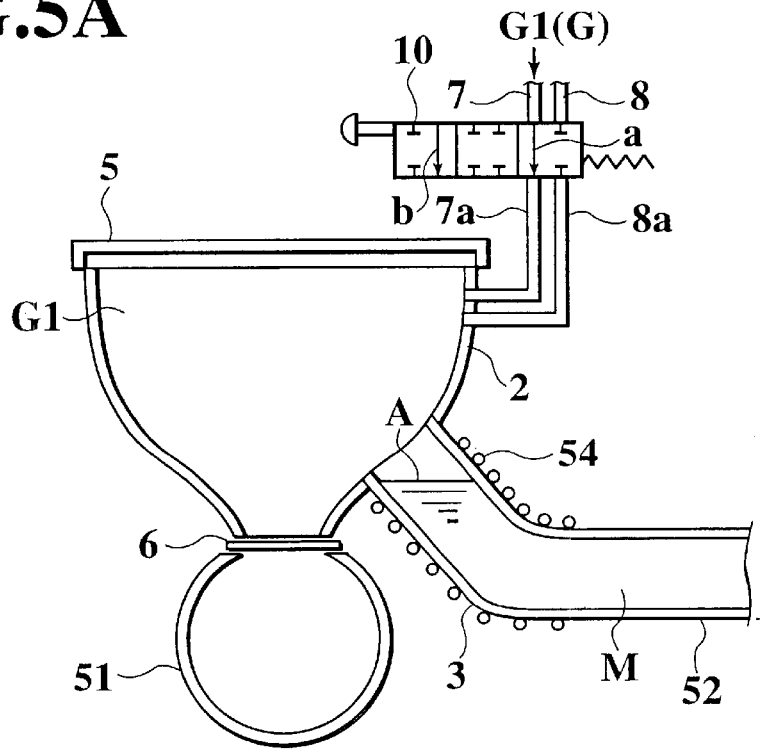
FIGS. 5A and 5B are schematic explanatory views illustrating a portion of a molten magnesium supplying apparatus according to a third embodiment of the invention, in which FIG. 5A and 5B respectively illustrate supplying states of different anti-oxidization gases.
Figure 5B:
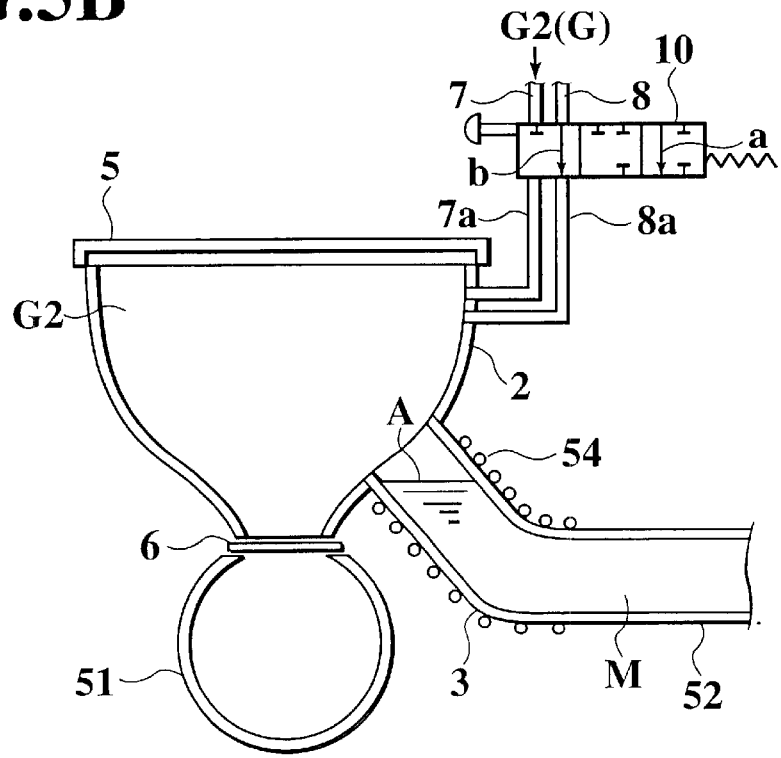
Figure 6A:
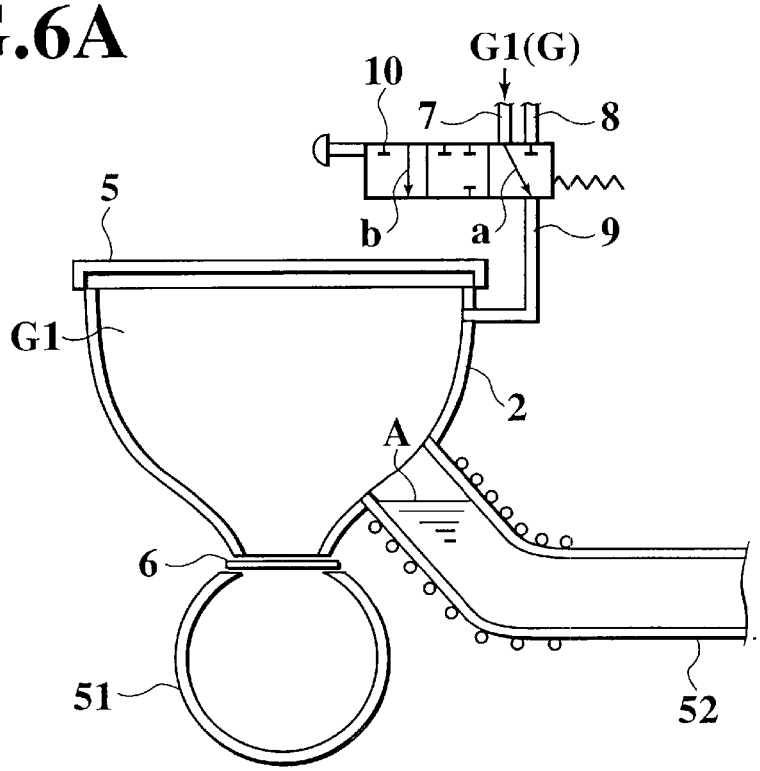
FIGS. 6A and 6B are schematic explanatory views illustrating a portion of a molten magnesium supplying apparatus according to a modified third embodiment of the invention, in which FIG. 6A and 6B respectively illustrate supplying states of different anti-oxidization gases.
Figure 6B:
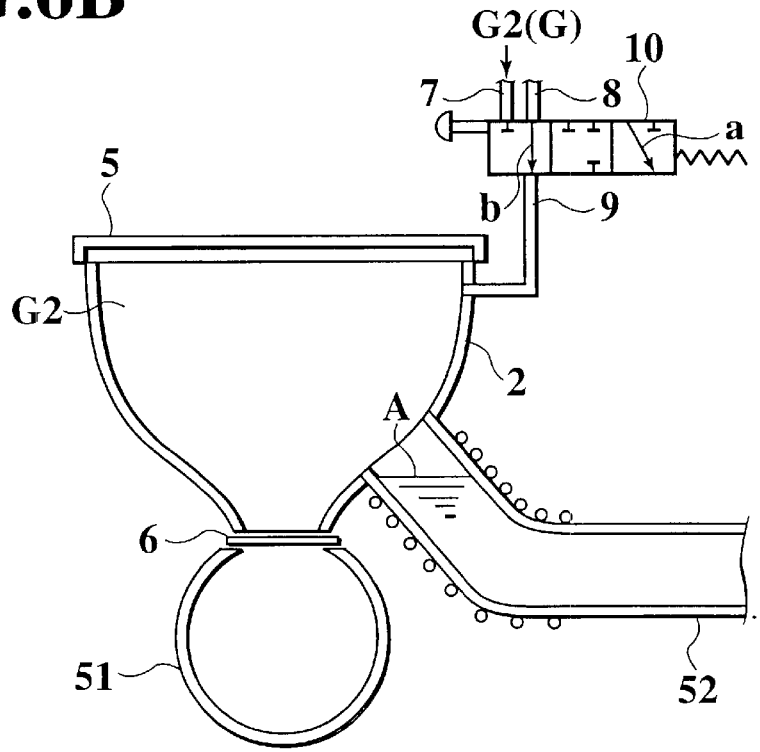

The molten magnesium supplying apparatus 1 thus constituted is further constituted as a first embodiment illustrated in FIG. 3, a second embodiment illustrated in FIG. 4, a third embodiment illustrated in FIGS. 5A and 5B, and a fourth embodiment illustrated in FIGS. 6A and 6B.

As shown in FIG. 3, the first embodiment is constituted with a throttle part 4 formed at a portion of the bent pipe portion 3 of the molten metal transfer pipe 52 by reducing the diameter of the portion. The throttle part 4 is formed a portion of the bent pipe portion 3 close to the funnel portion 2, and it is provided, for example, by machining the portion to reduce the diameter of the bent pipe portion 3 itself or by welding a machined pipe to the bent pipe portion 3.

In this embodiment, when molten magnesium M is supplied to the injection sleeve 51, it passes through the throttle part 4. At a time of the passing-through of the molten magnesium M, the throttle part 4 can develop the same pressure effect as that of a conventional fixed throttle and a supply amount of molten magnesium is made stable, which results in a stable die casting work.

The throttle part 4 can be subjected to maintenance and cleaning work from the funnel portion 2 without disassembling the molten metal furnace 52, which results in a high working easiness in maintenance.

That is, the funnel portion 2 is opened at its upper part 2*b* to the injection sleeve 51 and is opened at its lower part serving as a delivery opening 2*a* and, thus, the entire shape thereof is formed in a funnel shape. The upper part 2*b* is covered with a attachable/detachable lid 5 and the lower part is closed by a shutter 6 such that it can be opened/closed. At this time, as the lid 5 is merely put on the upper part 2*b* to cover the opening thereof, it can easily be detached, and maintenance and cleaning works of the funnel portion 2 and portions around the same can easily be carried out through the opening of the upper part 2*b* of the funnel portion 2 by detaching the lid 5.

Incidentally, the shutter 6 is provided so as to be opened in an interlocking manner with operation of the electromagnetic pump 50 only at a time of delivery of molten magnesium M. Furthermore, the funnel portion 2 does not require an outside heater necessarily and it is normally constituted without the heater in view of simplification of its structure.

As illustrated in FIG. 4, the second embodiment is structured such that a lower side portion 2*c* of the funnel portion 2 extending from a communication part 2*d* with the bent pipe portion 2 to the delivery opening 2*a* to the injection sleeve 51 has an inside surface 2*e* which is gradually reduced in inside diameter from the communication part 2*d* towards the delivery opening 2*a* and is bent smoothly.

For example, the inside surface 2*e* has a curved line which is sloped from the communication part 2*d* as an origin downwardly at an angle of about 40 degrees and in which the inclination angle θ increases continuously towards the lower side portion 2*c* within 90 degrees, and it is constituted as a curved face obtained by rotating the curved line about an axial line C passing through the center of the delivery opening 2*a*.

The funnel portion 2 is formed in a funnel shape as a whole, and is structured in a similar manner to the first embodiment by causing the upper end of the bent pipe portion 3 to communicate with a boundary portion between a cylindrical funnel upper part and a funnel lower part having a gradually reduced diameter. This funnel portion 2 is formed of, for example, a plate material of iron system having a thickness of 2 mm or less, and aluminizing processing is effected on a surface (an inside surface) of the formed funnel portion 2 and further a secondary diffusion processing is performed on the aluminized funnel portion 2.

In this second embodiment, as supplying molten magnesium to the injection sleeve 51 is carried out from the molten magnesium melt level A close to the delivery opening 2*a* of the funnel portion 2, a falling-down head of molten magnesium M can be reduced. Also, as the inside surface 2*e* of the lower part 2*c* of the funnel portion 2 is formed in a smooth flowing-out sloped surface having an angle of about 40 degrees or more, the molten magnesium M is supplied to the injection sleeve 51 in a less turbulence condition.

According to the second embodiment, therefore, oxidization of the molten magnesium M and reaction product at a delivery end (the delivery opening 2*a*) are prevented from occurring, such a trouble as combustion, blocking, staying or the like due to occurrences of the oxidization and the reaction product is prevented from occurring. Also, molten magnesium supply can be ended in an excellent state, so that a high working easiness can be obtained in maintenance and supply of molten magnesium is made stable, which results in a stable die casting work.

Furthermore, as illustrated in FIGS. 5A, 5B, 6A and 6B, the third and the fourth embodiment is constituted such that anti-oxidization gas G includes gases of two different kinds of inert gas G1 and $SF_6$ dilute antideflagrant gas G2, and the inert gas G1 and the $SF_6$ dilute antideflagrant gas G2 supplied from gas supply lines 7 and 8 of two systems are respectively supplied to the funnel portion 2 at the constant melt level control time and the constant melt level non-control time.

At this time, the second embodiment is preferably constituted such that supply of $SF_6$ dilute antideflagrant gas G2 is controlled by a control valve 10 operated according to ON/OFF signals for controlling the constant melting face in the molten metal furnace 55.

In the third embodiment, the gas supply lines 7, 8 of two system are connected at their gas injecting ends 7*a*, 8*a* to an upper side wall of the funnel portion 2 through the control valve 10 (refer to FIGS. 5A, 5B), or respective gas injection ends of the gas supply lines 7, 8 are combined in one gas injection end 9 which is connected to an upper side wall of the funnel portion 2 (refer to FIGS. 6A, 6B). The gas injection ends 7*a*, 8*a* (or gas injection end 9) are easily connected to the funnel portion 2, as the funnel portion 2 is constituted without any heater. Also, as the connection is performed apart from the lid 5, opening/closing work of the lid 5 can easily be conducted at a time of maintenance.

The control valve 10 thus mounted causes the gas supply line 7 and the gas injection end 7*a* to communicate with each other (refer to FIG. 5), or it causes the gas supply line 7 and the gas injection end 9 to communicate with each other (refer to FIG. 6A), via its port 'a' by input of ON signal for controlling the constant melt level at a supply time of molten magnesium, while the control valve 10 causes the gas supply line 8 and the gas injection end 8*a* to communicate with each other (refer to FIG. 5B), or it causes the gas supply line 8 and the gas injection end 9 (refer to FIG. 6B), via its port b by input of OFF signal for stopping the constant melt level at a non-supply time of molten magnesium. Thereby, the funnel portion 2 is filled with the inert gas G1 supplied thereto from the gas supply line 7 at the supply time of molten magnesium (refer to FIGS. 5A and 6A), while it is filled with the $SF_6$ dilute antideflagrant gas G2 supplied thereto from the gas supply line 8 at a non-supply time of the molten magnesium (refer to FIGS. 5B and 6B).

In this time, particularly, switching-over between the gas supply lines 7, 8 of two systems is conducted as follows:

That is, when the constant melt level control is turned ON, after time delay lapsing until the melt level A of the molten magnesium M in the molten metal transfer pipe 52 reaches a holding level is estimated, supply of only the inert gas G1 is effected, while supply of only the $SF_6$ dilute antideflagrant gas G2 is effected immediately after the constant melt level control is turned OFF.

According to the third embodiment, the inert gas G1 is filled in the funnel portion 2 at a time of the constant melt level control on the molten metal furnace 55, so that occurrence of oxidization of magnesium M and reaction product is suppressed and molten magnesium to the injection sleeve 51.

Also, at a constant melt level non-control on the molten metal furnace 55, the $SF_6$ dilute antideflagrant gas G2 is filled in the funnel portion 2, so that occurrence of oxidization of magnesium M and reaction product can be suppressed at this time.

Thus, in the third embodiment, as occurrence of oxidization of magnesium M and reaction product can be suppressed both at the supply time of molten magnesium and the non-supply time to the injection sleeve 51 thereof, attaching of magnesium oxide on an apparatus inner wall and/or deposition thereof on a bottom portion of the apparatus are reduced and molten magnesium supply can be ended in an excellent state. Accordingly, an excellent working easiness can be obtained in maintenance and a supply amount of molten magnesium is made stable, which results in a stable die casting work.

Incidentally, the $SF_6$ dilute antideflagrant gas G2 which is relatively inexpensive and which has an antideflagrant effect larger than that of inert gas is supplied to the molten metal furnace 55 as the anti-oxidization gas G (refer to FIG. 2).

The molten magnesium supplying apparatus of the present invention is not limited to only the embodiments, but it includes a combination of the first and second embodiments, a combination of the second and third embodiments, and a combination of the first to third embodiments. Each combination provides further easiness in maintenance work and provides more stable molten magnesium supply.

The electromagnetic pump 50 serving as a fluid streaming type transfer mechanism may be substituted with another molten magnesium transfer mechanism or means of a fluid streaming type, or may preferably be replaced by a molten magnesium transfer mechanism of means of a volume replacement type, such a screw pump, a metal pump, etc.

A fourth embodiment will be explained with reference to FIGS. 7 and 8 below.

Figure 7:
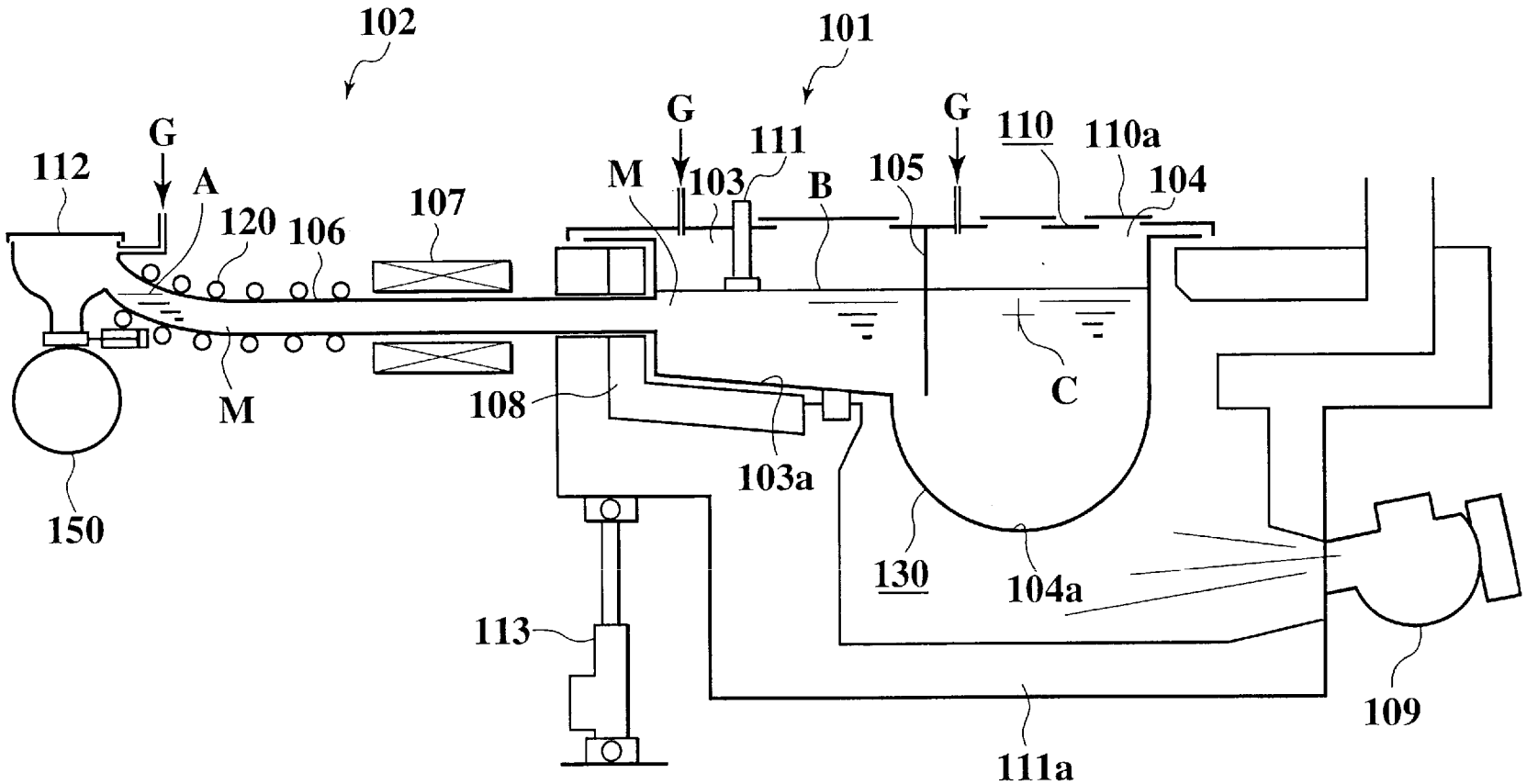
FIG. 7 is a schematic view illustrating a horizontally held state of a melting and holding furnace with a tilting mechanism according to a fourth embodiment.
Figure 8:
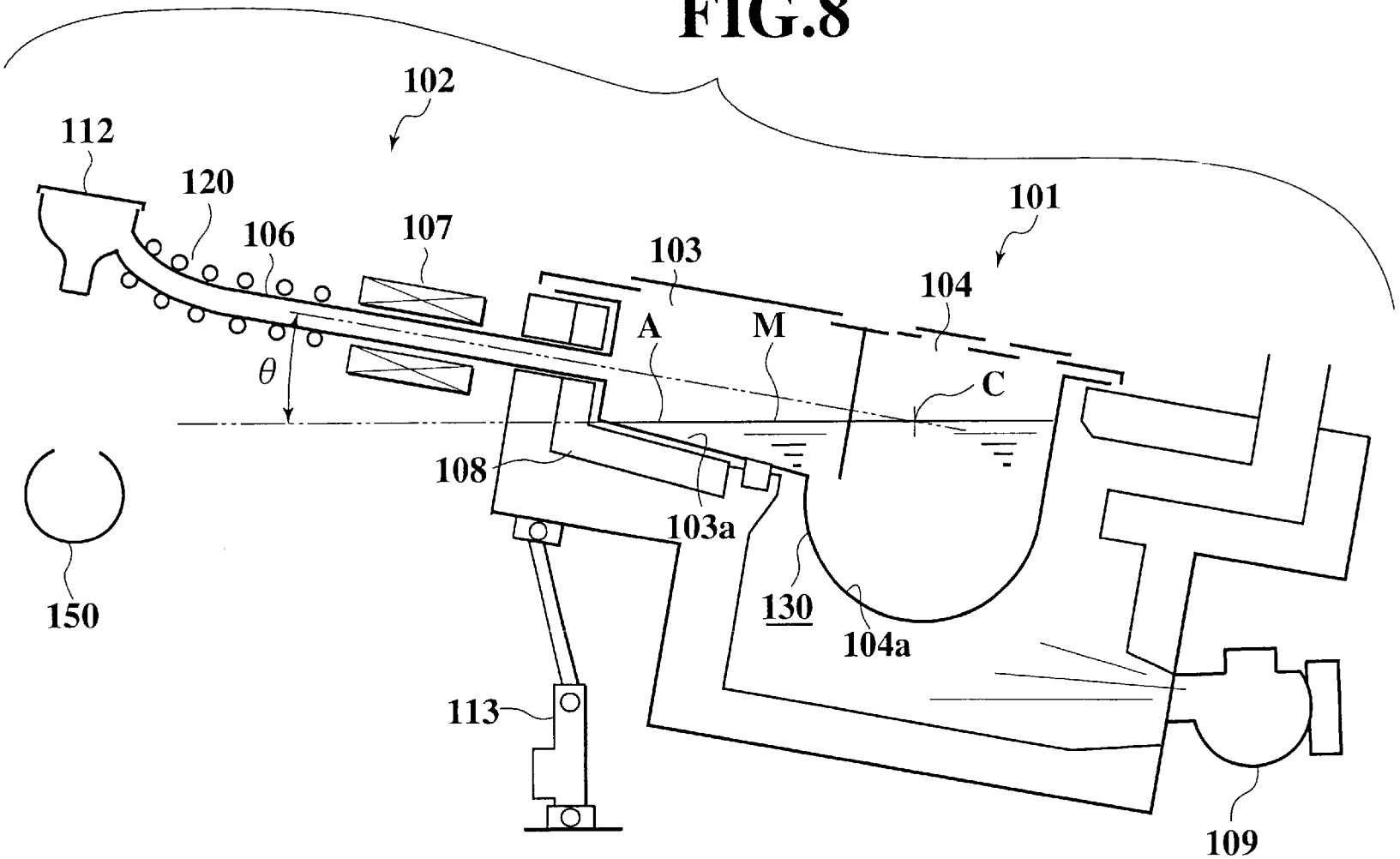
FIG. 8 is a schematic view illustrating a tilted and held state of the melting and holding furnace with a tilting mechanism in FIG. 7.

FIG. 7 illustrates a horizontally held state of a melting and holding furnace with a tilting mechanism, and FIG. 8 illustrates a tilted and held state thereof in FIG. 7.

This melting and holding furnace 101 with a tilting mechanism comprises a melting and holding furnace section 101 constituted with a crucible 130 whose interior is partitioned to a holding chamber 103 and a melting chamber 104 by a partition portion 105 such that molten magnesium M is mutually movable between the holding chamber 103 and the melting chamber 104, the bottom portion 104*a* of the melting chamber 104 being lower than the bottom portion 103*a* of the holding chamber 103, and heating means 8, 9 being respectively provided for heating the holding chamber 103 and the melting chamber 104 exclusively;

- a molten metal supplying apparatus 102 provided so as to communicate with the holding chamber 103, for supplying the molten magnesium M into an injection sleeve 150 of a die casting machine (not shown); and
- a tilting mechanism 113 for holding the melting and holding furnace section 101 horizontally and for, as occasion demands, tilting the melting and holding furnace 101 together with the molten metal supplying apparatus 102 upwardly about the melting chamber 104 serving as a tilting fulcrum C to hold the same in the tilted position.

The melting and holding furnace section 101 is closed at an upper opening of the crucible 130 extending over the holding chamber 103 and the melting chamber 104 by a furnace lid 110, and a space between the furnace lid 110 and a melt level A of molten magnesium M received inside the holding chamber 103 and the melting chamber 104 is filled with antideflagrant gas. The antideflagrant gas is filled in both spaces of the holding chamber 103 and melting chamber 104. An ingot charging lid 110*a* is provided at a portion of the furnace lid 110 which corresponds to the melting chamber 104 and which is spaced from the holding chamber 103 as far as possible such that it can be opened/closed. Magnesium ingot (not shown) can be charged to the melting chamber 104 through the opened ingot charging lid 110*a*.

A melt level level 111 is disposed in the holding chamber 103 in a floating manner on melt level A. Charging of magnesium ingot is controlled or managed by the melt level level 111 such that melt level is constant. Molten magnesium M or magnesium ingot melted moves through the partition portion 105 to the holding chamber 103.

The melting chamber 104 has the bottom portion 104*a* formed so as to extend below the bottom portion 103*a* of the holding chamber 103. As illustrated in this embodiment, preferably, the holding chamber 103 is formed at the bottom portion with an approximately flat bottom 103*a* and the melting chamber 104 is formed with a downwardly concave round bottom 104*a* extending from the approximately flat bottom 103*a*. The heating means constituted with an electric heater 108 disposed at the holding chamber 103 side and a gas burner 109 disposed at the melting chamber 104 side. As the electric heater 108, a flat heater well conformable to the approximately flat bottom 3*a* can be employed, and the gas burner 109 is mounted so as to face an opening of a furnace wall 101*a*. Thereby, temperature of molten magnesium M in the holding chamber 103 is controlled by the electric heater 108 without influence of temperature of molten magnesium in the melting chamber 104, and magnesium ingot charged to the melting chamber 104 is melted by heating of the gas burner 109.

The molten metal charging apparatus 102 is constituted with a transfer pipe 106 with an electromagnetic pump 107 provided so as to communicate with the holding chamber 103 and a funnel 112 communicating with a delivery end of the transfer pipe 106 and provided so as to be opposed to a molten metal supply port of an injection sleeve 150. The transfer pipe 106 can be heated by a heater 120 provided around the pipe 106.

A melt level B of molten magnesium in the transfer pipe 106 can be maintained close to the funnel 112 by performing a constant melt level control on the melting and holding furnace 101 during die casting work. Supply of molten magnesium to the injection sleeve 150 is effected such that molten magnesium is delivered from the transfer pipe 106 to the funnel 112 by the electromagnetic pump 107 provided on transfer pipe 106 and a whole amount of molten magnesium delivered is poured into the injection sleeve 150 via the funnel 112. At this time, as the molten metal to be handled is molten magnesium alloy, a space from the melt level B to a delivery side is put in a filled state with antideflagrant gas. Incidentally, an opening/closing shutter is provided at a lower part of the funnel 112 such that the lower part is put in a closed state at a time of non-supply of molten magnesium.

The tilting mechanism is constituted with an electrical lifter 113 in this embodiment. The electric lifter 113 is grounded at its distal end and it is rotatably mounted at its proximal end to the furnace wall 1*a* of a holding chamber 103 side of the melting and holding furnace 101. The melting and holding furnace 101 is maintained horizontally during die casting by the electrical lifter 113 and a pivoting member (not shown) pivoting the furnace 110*a* of the melting chamber 104 side and it is tilted around the pivoting portion of the melting chamber 104 side serving as a tilting fulcrum by stretching operation of the electrical lifter 113 as occasion demands such as maintenance work.

In this embodiment, a tilting fulcrum C serving at this time is provided at an approximately central portion of the melting chamber 104. Accordingly, as illustrated in FIG. 8, the melting and holding furnace 101 is tilted together with the molten metal supplying apparatus 102, and the transfer pipe 106 and the funnel 112 which are far from the tilting fulcrum C are tilted and maintained in a state in which they are spaced from the injection sleeve 150. A tilted or inclination angle θ in this tilted and maintained position is set so as allow easy discharging of molten magnesium M from the transfer pipe 106 of the molten metal supplying apparatus 102, the electromagnetic pump 107 and the like to the crucible 130.

In the melting and holding furnace with a titling mechanism thus structured, dross/sludge occurring in the melting chamber 104 during melting of magnesium ingot and/or molten magnesium M with a high specific gravity which has just been cold-charged to be melted are deposited or stayed at the round bottom 104*a* owing to differences in shape and in height between the bottom portions of the holding chamber 103 and the melting chamber 104 so that they can prevented from moving to the holding chamber 103. Thereby, trouble is also prevented from occurring at the inside of the transfer pipe 106 and die cast products of a good quality can be obtained in a stable manner.

Also, respective temperature controls in the holding chamber 103 and the melting chamber 104 can respectively be performed by the electric heater 108 and the gas burner 109 independently from the temperatures in the adjacent chambers 103 and 104, and, in addition thereto, the temperature of molten magnesium in the holding chamber 103 can be controlled or adjusted with a high accuracy by a rapidly controllable electric heater 108 while molten magnesium M with a high specific gravity which has just been melted down is prevented from flowing in the holding chamber 103. Also, magnesium ingot charged to the melting chamber 104 can be rapidly melted by excellent heat transfer of the gas burner 109 to the round bottom 104*a*. Particularly, variation in fluidic characteristic of temperature of molten magnesium M in the transfer pipe 106 can be suppressed by maintaining the temperature of molten magnesium in the holding chamber 103 so that a supply amount of molten magnesium is made stable. As a result, die cast products can be obtained in a stable manner.

Also, when the melting and holding furnace 101 together with the molten metal supplying apparatus 102 is tilted and maintained in the tilted position by the electrical lifter 113, molten magnesium M in the molten metal supplying apparatus 102 can be delivered in the crucible 130 without staying, so that maintenance work can easily be effected on, for example, the transfer pipe 106, the heater 120 thereabout, or the like.

Furthermore, as the bottom portion of the melting chamber 104 is formed in the round bottom 104*a*, melting work in which supply work of molten magnesium is not effected can be effected while the melting and holding furnace 101 is maintained in its tilted position (refer to FIG. 8), so that dross/sludge occurring during melting work and molten magnesium M with a high specific gravity which has just melted down can approximately completely be prevented from moving to the holding chamber 103. As a result, troubles occurring in the inside of the transfer pipe 106 are suppressed so that maintenance work can be facilitated and die cast products of a good quality can be obtained in a more stable manner.

A fifth embodiment of the invention will be explained with reference to FIGS. 9 to 12 below.

Figure 9:
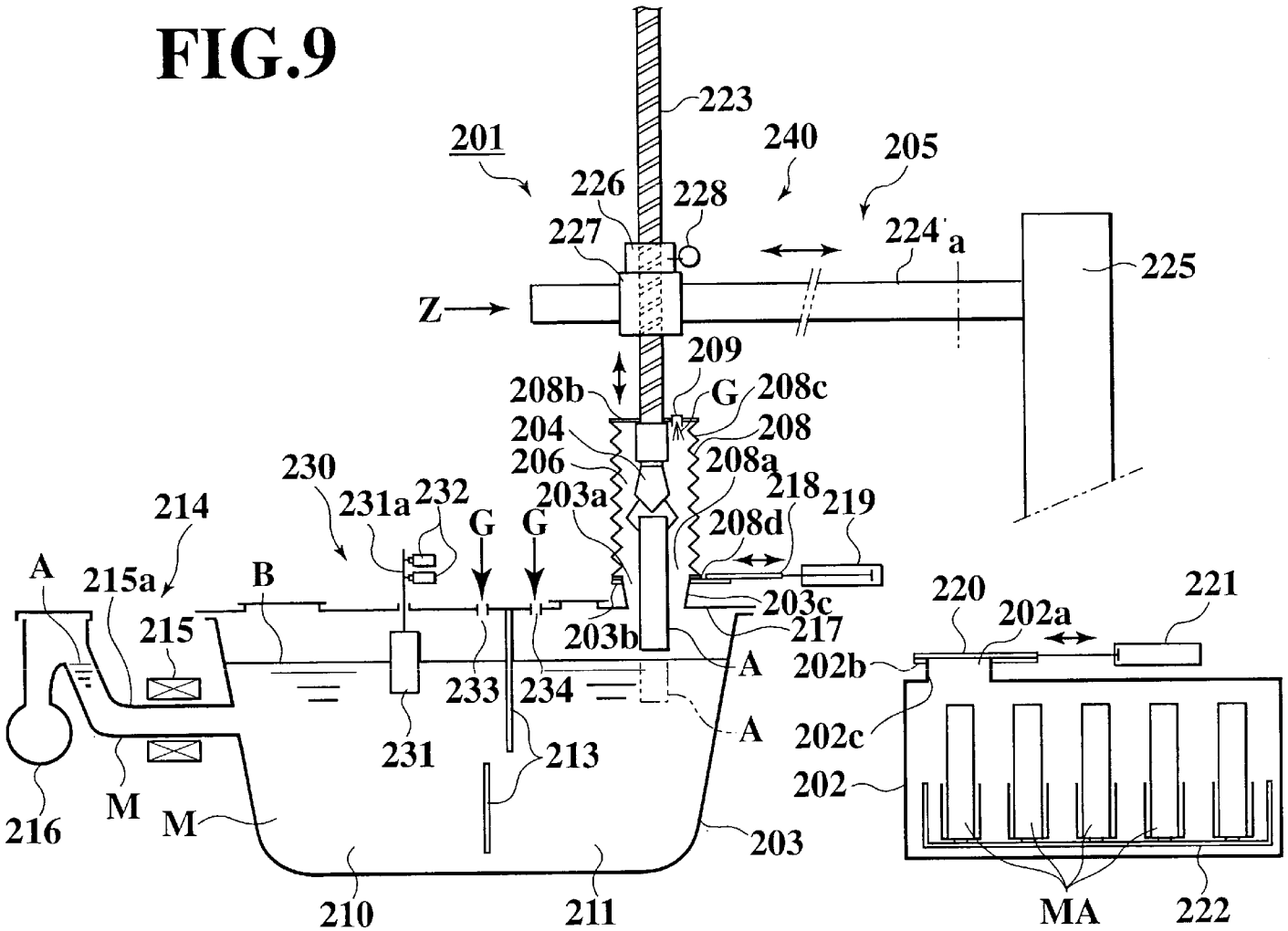
FIG. 9 is an explanatory view illustrating an ingot charging step of an ingot charging apparatus according to a fifth embodiment.
Figure 10:
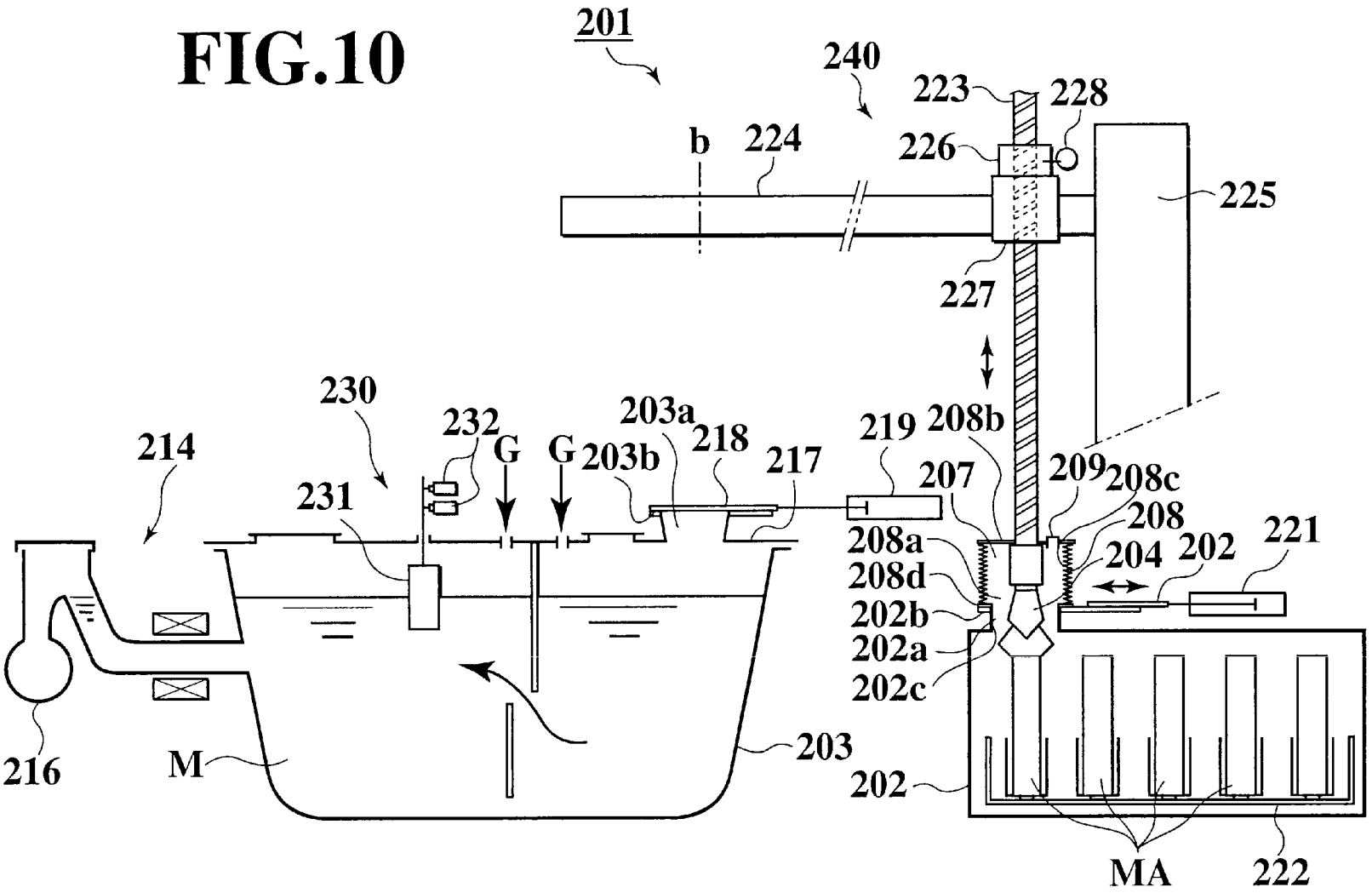
FIG. 10 is an explanatory view illustrating an ingot discharge step of the ingot charging apparatus according to the fifth embodiment.

FIGS. 9 and 10 illustrate an ingot charging apparatus 201 according to the fifth embodiment. The ingot charging apparatus 201 is for charging a preheated magnesium ingot MA from a preheating apparatus 202 to a melting and holding furnace 203, and it is constituted with conveying means 205 for discharge each preheated magnesium ingot MA from the preheating apparatus 202 by holding it by an ingot chuck 204 and for conveying the preheated magnesium ingot MA to the melting and holding furnace 203 to discharge and charge the same thereto, and a hood 208 mounted to the conveying means 205, which, at a time of discharge the preheated magnesium ingot MA and at a time of charging the same, communicates with an ingot discharge port 202*a* of the preheating apparatus 202 and an ingot charge port 203*a* of the melting and holding furnace 203*a* to form closed spaces 207 and 206 for allowing discharge operation of the preheated magnesium ingot MA and charge operation thereof and which covers the preheated magnesium ingot MA held by the ingot chuck 204 during conveyance of the preheated magnesium ingot MA.

The preheating apparatus 202 is constituted with a moving stand 222 having a frame on which magnesium ingots MA can be put in their standing manner such that their longitudinal axes are vertical, a preheater (not shown), an ingot discharge port 202*a*, and a discharge port shutter 220 for opening/closing the ingot discharge port 202*a*. The moving stand 222 is disposed to be movable in a tact feeding manner and the interior of the preheating apparatus 202 is preheated to a preheating temperature. The ingots MA on the moving stand 222 are moved while being heated and their are raised. Each ingots MA on the moving stand 222 whose preheating has been completed is put in a standby state below the closed discharge shutter 220. The preheated condition of the ingot MA is monitored by a thermocouple temperature sensor (not shown). The discharge shutter 220 is provided to be movable in a reciprocating manner by a shutter driving cylinder 221, and it is put in a closed state when discharge of the ingot MA is not effected. The ingot discharge port 202*a* is formed such that a tubular or cylindrical body 202*c* provided at its upper part with a flange-shaped hood receiver 202*b* is provided at an upper part of the preheating apparatus 202 so as to communicate with an interior thereof. The ingot discharge port 202*a* is closed by placing the discharge shutter 220 on the hood receiver 202*b* (refer to FIG. 9).

The melting and holding furnace 203 includes therein a holding chamber 210 and a melting chamber 211 which are partitioned by a partition portion 213 such that molten magnesium M can flow in these chambers 210 and 211 mutually. Upper openings of the holding chamber 210 and the melting chamber 211 are closed by a furnace lid 217. The furnace lid 217 has gas injection ports 233 and 234 for respectively injecting antideflagrant gas G into the holding chamber 210 and the melting chamber 211 and an ingot charge portion 203*a* corresponding to the melting chamber 211. The ingot charge port 203*a* is formed such that a tubular or cylindrical body 203*c* provided at its upper part with a flange-shaped hood receiver 203*a* is provided at the furnace lid 217 so as to communicate with the interior of the melting and holding furnace 203. The ingot charge port 203*a* is closed by a charge port shutter 218 for flame prevention and heat insulation when charging of the ingot MA is not conducted. The charge port shutter 218 is disposed so as to be movable in a reciprocating manner by a shutter driving cylinder 219. The ingot charge port 203*a* is closed by the charge port shutter 218 thereon (refer to FIG. 10).

Also, a melt level detecting portion 230 is provided in the holding chamber 210 of the melting and holding furnace 203. The melt level detecting portion 230 is constituted with a float 231 floating on molten magnesium M, an indication portion 231*a* implanted on the float 231 projecting above the furnace lid 217, and two sensor portions 232 provided at a projecting portion of the indication portion 231*a* so as to be opposed to each other along a vertical direction. The melt level detecting portion 230 detects the position of the indication portion 231*a* moving vertically according to an amount of molten magnesium M in the holding chamber 210 to detect the melt level B of molten magnesium M in the holding chamber 210 (and the melt level A of molten magnesium M in the molten metal transfer pipe 215*a*).

Furthermore, a molten metal supplying apparatus 214 for supplying molten magnesium M in the holding chamber 210 to an injection sleeve 216 of a die casting machine is provided at the holding chamber 210 of the melting and holding furnace 203 so as to communicate therewith. The molten metal supplying apparatus 214 transfers molten magnesium M in the furnace 203 via the molten metal transfer pipe 215*a* by an electromagnetic pump 215 to supply the same in the injection sleeve 216 from a delivery end of the molten metal transfer pipe 215*a*. A delivery amount of molten magnesium M supplied by the electromagnetic pump 215 is set according to the size of a die casing product and/or the heights of molten magnesium melt levels (melt levels B and C) such that a constant amount of molten magnesium is supplied to the injection sleeve 216 (refer to FIG. 9).

In this embodiment, the conveying means 205 is constituted with an air-type rodless cylinder 224 mounted horizontally to a strut 225, an electromotive ball screw 240 moved horizontally along the rodless cylinder 224, and the ingot chuck 204 fixed to the electromotive ball screw 240. The electromotive ball screw 240 is configured with a nut member 226 mounted rotatably on a cylinder weight receiving portion 227 of the rodless cylinder 224 to be rotated by drive of a motor 228, and a ball screw portion 223 provided so as to be engaged with the nut member 226 in a threading manner and to pass through the nut member 226 and a guide portion 227*a* (refer to FIG. 12) of the cylinder weight receiving portion 227. The ball screw portion 223 is moved vertically by rotation of the nut member 226. The ingot chuck 204 is mounted to a lower end portion of the ball screw portion 223 and it is controlled so as to hold or grasp the ingot MA and release the same grasped according to instruction signals from a control portion (not shown).

The moved position of the rodless cylinder 224 is indicated with the position of the cylinder weight receiving portion 227. Accordingly, the cylinder weight receiving portion 227 together with the electromotive ball screw 240 is structured so as to be moved horizontally on the cylinder 224 according to cylinder instructions.

In this embodiment, a position 'a' (refer to FIG. 9) where the ingot MA is held or grasped and a position b (refer to FIG. 9) where the ingot MA is released are determined on the cylinder 224, and the ball screw portion 223 is moved horizontally between the two positions 'a' and b. The releasing position b corresponds to the ingot charge port 203*a* of the melting and holding furnace 203 and the grasping position b corresponds to the ingot discharge port 202*a* of the preheating apparatus 202.

Figure 11:
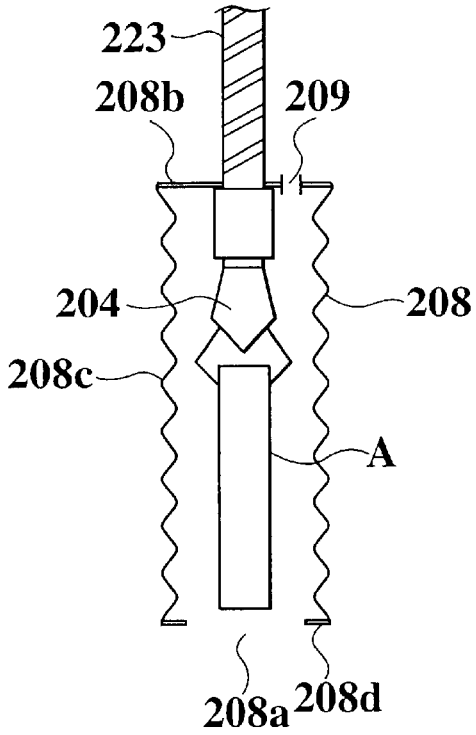
FIG. 11 is an explanatory view illustrating a main portion of an ingot conveying step of the ingot charging apparatus according to the fifth embodiment.
Figure 12:
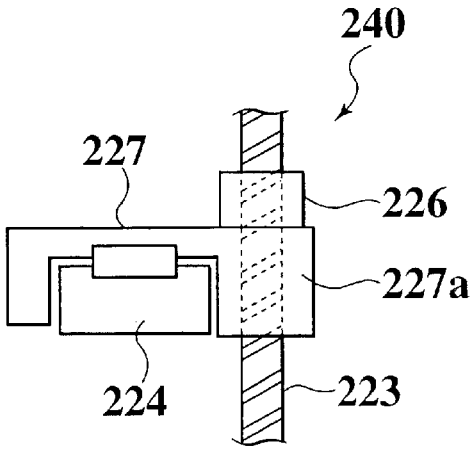
FIG. 12 is a view illustrating conveying means of the ingot charging apparatus of the fifth embodiment, which is viewed along arrow Z in FIG. 9.

As illustrated in FIG. 11, the hood 208 has such an inside diameter that it can accommodates the ingot chuck 204, and it is constituted with a tubular body 208*c* having an outer portion formed in a bellows shape stretchable/shrinkable in an axial direction, a supporting plate 208*b* mounted to a proximal end portion of the ingot chuck 204 and fixed with an upper end portion of the tubular body 208*c* for supporting the tubular body 208*c* in a suspended position, and a ring member 208*d* forming an opening 208*a* of the hood 208, which is fixed at a lower end portion of the tubular body 208*c*.

Preferably, the hood 208 has a gas injection port 209 for antideflagrant gas. In this embodiment, the gas injection port 209 is provided in the supporting plate 208*b*.

Specifically, as illustrated in FIG. 11, the hood 208 is stretched with the own weight of the ring member 208*d* in a free position so as to cover the magnesium ingot MA held by the ingot chuck 204. When the magnesium ingot MA is taken out, the ring member 208*d* abuts on the hood receiving portion 202*b* of the ingot discharge port 202*a*, in which the discharge port shutter 220 has been opened, to cause the opening 208*a* to communicate with the interior of the preheating apparatus 202, so that the closed space 207 for allowing discharge operation of the ingot chuck 202 is formed in the hood 208 (refer to FIG. 10). When the magnesium ingot MA is charged, the ring member 208*d* abuts on the hood receiving portion 203*b* of the ingot charge port 203*a*, in which the charge port shutter 218 has been opened, to cause the opening 208*a* to communicate with the interior of the melting chamber 211, so that the closed space 206 for allowing charge operation of the ingot chuck 204 is formed in the hood 208 (refer to FIG. 9).

An ingot charging method using the ingot charging apparatus 201 thus structured is as follows:

That is, a preheated magnesium ingot MA is held by the ingot chuck 204 in a standing position in which its longitudinal axis is vertical, and it is taken out from the preheating apparatus 202 and conveyed by the conveying means 205. In a state in which antideflagrant gas G injected from the gas injection port 209 is filled in the closed space 206 formed by the hood 208 communicating with the ingot charge port 203*a* of the melting and holding furnace 203, most portion of the magnesium ingot MA is immersed in molten magnesium M in the melting and holding furnace 203 according to a low speed vertical downward movement of the ingot chuck 204, and then it is released and charged in the melting chamber 211.

Particularly, the method is implemented in the following manner.

In an ingot discharge step for discharge a magnesium ingot MA from the preheating apparatus 202, the ingot charging apparatus 201 put the ingot chuck 204 in a standby sate just above and near the upper part of the discharge port shutter 220. At this time, the ring member 208*d* positioned at a lower end of the hood 208 comes in contact with an upper face of the discharge port shutter 220. In the preheating apparatus 202, magnesium ingots MA which have been set on the moving stand 222 are put in a standby state.

In this state, the discharge port shutter 220 is opened according to a charging instruction or command from the melting and holding furnace 203. The charging instruction issued at this time may be a detection signal for detecting melt level B of molten magnesium in the melting and holding furnace 203 or a starting signal generated by a push bottom or the like operated by an operator observing the melt level B.

As the discharge port shutter 220 is opened, the ring member 208*d* abuts on the hood receiving portion 202*b*, further the ingot chuck 204 continues to lower according to downward movement of the ball screw portion 223, and it holds or grasps a completely preheated magnesium ingot MA positioned at a predetermined height (refer to FIG. 10). At this time, the hood 208 allows downward movement of the ball screw portion 223 as a length of the hood 208 is shrunk along an axial direction.

Thereafter, the ball screw portion 223 is moved upwardly up to a home position, so that one magnesium ingot MA is securely taken out from the preheating apparatus 202. Immediately after discharge, the ingot discharge port 202*a* is closed by the discharge port shutter 220.

In this ingot discharge step, as the closed space 207 is formed outside the ingot discharge port 202*a* by the hood 208, heat dissipation from the preheating apparatus 202 can be suppressed to the utmost.

Furthermore, after the ball screw portion 223 is moved upwardly to a predetermined horizontal movement position, the electromotive ball screw 240 is operated for a horizontal movement of the cylinder weight receiving portion 227 (ingot conveying step), the operation of the electromotive ball screw 240 is stopped when the cylinder weight receiving portion 227 reaches the position b for releasing the ingot MA on the cylinder 224, and downward movement of the ball screw portion 223 starts. At this time, the gas injection port 209 starts to inject antideflagrant gas G in the hood 208.

In the ingot conveying step, as the preheated magnesium ingot Ma grasped by the ingot chuck 204 is conveyed in a state in which it is covered with the stretched hood 208 (refer to FIG. 11), heat dissipation is suppressed so that lowering of the temperature of the ingot MA itself can be suppressed to the utmost.

In the course of downward movement of the ball screw portion 223, when the ring member 208*d* of the hood 208 comes in contact with the charge port shutter 218, the downward movement of the ball screw portion 223 is stopped once, and the charge port shutter 218 is opened. Thereafter, as the ring member 208*d* abuts on the hood receiver 203*b* of the ingot charge port 203*a* and the closed space 206 filled with antideflagrant gas G is formed outside the ingot charge port 203*a*, the interior of the melting and holding furnace 203 is shielded from outside air.

Furthermore, the ball screw portion 223 continue to lower down to a height in which the preheated magnesium ingot MA comes in contact with the melt level B of molten magnesium M. This height is an ingot immersion start height.

In order to immerse the preheated magnesium ingot MA in the molten magnesium M from the ingot immersion start height, vertically downward movement of the ingot chuck 204 is effected at a low speed. For example, this downward movement is performed at a much lower speed than the downward movement speed of the ball screw portion 223 before the contact of the ingot MA with the melt level B, or it is performed in an intermittent manner. This intermittent downward movement includes such an intermittent downward movement that, after the ingot MA is immersed by its ⅓ length, immersion thereof is stopped for 40 seconds, it is further immersed by its ⅓ length, immersion thereof is stopped for 30 seconds, and so on, or such an intermittent downward movement that, just when the molten metal supplying apparatus 214 should start molten metal supply operation, downward movement of the ingot MA is stopped and downward movement thereof restarts after supply operation of molten magnesium has been completed. The latter intermittent downward movement is effected such that identical conditions can be obtained at respective molten magnesium supply times (casting times) and stable casting conditions can be obtained for the respective molten magnesium supply times (casting times). Such a low speed downward movement of the ingot chuck 204 can be made possible by suppressing oxidization of molten magnesium in the melting chamber 211 with antideflagrant gas G filled in the closed space 206.

When the height of the ingot chuck 204 moving downward reaches a predetermined height, most portion of the preheated magnesium ingot MA is immersed in molten magnesium M. At this time, the ingot chuck 204 releases the preheated magnesium ingot MA into molten magnesium M in the melting chamber 211.

In this ingot charging step, as the preheated magnesium ingot MA is immersed, with its standing position in which its longitudinal axis is vertical, into the melting and holding furnace 203 (melting chamber 211) from the ingot charge port 203*a*, the opening area of the ingot charge port 203*a* can be set small, and correspondingly heat dissipation from inside of the melting and holding furnace 203 can be suppressed.

Also, as immersion of the preheated magnesium ingot MA to molten magnesium M is performed at a state in which antideflagrant gas G is filled in the closed space 206 and by vertically downward movement of the ingot chuck 204 at a low speed, the immersion can be carried out in a state in which oxidization of molten magnesium, variation in molten magnesium temperature, and/or disturbance of molten magnesium melt level and antideflagrant gas atmosphere is suppressed.

After this ingot charging step, when the electromotive ball screw 240 is put in an upward movement operation so that the ball screw portion 223 is moved upwardly to reach a predetermined height, the ingot charge port 203*a* is closed by the charge port shutter 218 and injection of antideflagrant gas G from the gas injection port 209 is stopped. Furthermore, when the ball screw portion 223 continues to move upwardly and reaches the height where the ingot chuck 204 can be moved horizontally, the upward movement thereof is stopped. Then, the ingot chuck 204 is put in a horizontal movement operation on the rodless cylinder 224, and the horizontal movement of the ingot chuck 204 is stopped at the position 'a' for grasping an ingot on the cylinder 224, where downward movement of the ball screw portion 223 starts as an operation for discharge another magnesium ingot MA from the preheating apparatus 202. The downward movement is further effected and stopped once at a predetermined height where the ring member 208 comes in contact with the discharge port shutter 220. At this position, the ingot chuck 204 is put in a standby state.

At this time, in the preheating apparatus 202, another ingot MA set on the moving stand 222 is made to stand by below the discharge port shutter 220. In this state, the discharge port shutter 220 is opened according to a charging instruction from the melting and holding furnace 203. The ring member 208*b* abuts on the hood receiver 202*b* of the ingot discharge port 202*a* through the opening, and the ingot chuck 204 continues to moved downward, so that the completely preheated magnesium ingot MA is grasped or held by the ingot chuck 204 at a predetermined height.

Thereafter, the operation of the ingot charging apparatus 201 is repeated. The magnesium ingot MA charged is melted near the ingot charge port 203*a* of the melting chamber 211 and molten magnesium M obtained by melting ingots moves to the holding chamber 210 positioned at an electromagnetic pump 215 inlet side through the partition plate 213.

According to the ingot charging method employing the ingot charging apparatus 201, thus, magnesium ingots MA can be charged to the melting and holding furnace 203 on the basis of instructions from the melting and holding furnace 203 without disturbing molten magnesium melt level and antideflagrant gas layer within the melting and holding furnace 203, and oxidization of molten magnesium M can be reduced and dross/sludge can be suppressed from occurring, which results in improvement in quality of die cast products obtained.

Also, as the ingot MA is charged with its standing position, the opening area of the ingot charge port 203*a* can be reduced. In the ingot charging step, as the closed space 206 is formed outside the ingot charge port 203*a*, heat dissipation from the interior of the melting and holding furnace 203 can be suppressed to the utmost so that molten magnesium temperature in the furnace 203 is made stable. As a result, when casting operation is performed in a die casting machine, fluidity of molten magnesium MA is prevented from deteriorating or varying, and die cast products of a good quality can be obtained in a stable manner.

Furthermore, automatic charging of preheated magnesium ingots MA is made possible, and thereby elimination or reduction of labor is not only allowed but also stabilization of the quality of die cast products obtained can be obtained in spite of repetitive charging of an ingot MA.

Besides, as the downward movement of the ingot chuck 204 in the ingot charging step can be effected at a low speed, variation of molten magnesium temperature at a charge time of an ingot MA and/or variation of melt level can be reduced to a great extent, thereby reducing variation of dynamic pressure in the molten metal transfer pipe 215*a*. In the molten magnesium supply system employing the electromagnetic pump 215 in this embodiment, metering accuracy for the delivery amount of molten magnesium is improved and molten magnesium of a constant and appropriate amount can be supplied.

This embodiment employs the method in which the ingot chuck 204 is moved horizontally between the position 'a' for grasping an ingot MA and the position 'b' for releasing the same on the rodless air cylinder 224, but the present invention is not limited to this method. The present invention may employ a method in which the vertical movement of the ingot chuck 204 is effected by an electromotive ball screw type drive similar to that of the embodiment, but movement of the ingot chuck 204 between the two positions 'a' and 'b' is performed by a mechanism in which the electromotive ball screw 240 is mounted to a side plate portion rotatably provided on the strut 225 and the electromotive ball screw 240 is pivoted about the strut 225, thereby moving the electromotive ball screw 240. In this case, as charge operation of a preheated magnesium ingot MA can be performed by moving the ingot chuck 204 between the two positions 'a' and 'b' through the pivoting operation of the electromotive ball screw 240, simplification of the structure of an ingot charging apparatus can be facilitated.

In this embodiment, the melting and holding furnace 203 is constituted with the holding chamber 210 and the melting chamber 211 partitioned by the partition portion 213, but this invention is not limited to this constitution. Of course, the present invention is applicable to a melting furnace in a case of two-pot type in which a melting chamber and a holding chamber are provided independently from each other.

While preferred embodiments of the present invention have been described using specific terms, such description is for illustrative purposes, and it is to be understood that changes and variations may be made without departing from the scope of the following claims.

What is claimed is:

1. A molten magnesium supply system including:

a molten metal furnace put under a melt level control;

a molten magnesium supplying apparatus comprising a molten metal transfer pipe communicating at one end thereof with the molten metal furnace, the molten metal transfer pipe having at another end thereof an ascending bent pipe portion as a delivery portion for delivery of molten magnesium to be supplied to an injection sleeve, and molten metal transferring means for forcing molten magnesium from the molten metal furnace to be transferred in the molten metal transfer pipe and delivered through the delivery portion; and gas supplying means for supplying an anti-oxidization gas to vacant spaces in the molten metal furnace and the molten metal transfer pipe, wherein the molten metal transfer pipe is provided with a funnel portion communicating with the delivery portion, for receiving delivered molten magnesium from the delivery portion and supplying received molten magnesium to the injection sleeve.

2. A molten magnesium supply system according to claim 1, wherein the bent pipe portion is reduced to have a throttle part.

3. A molten magnesium supply system according to claim 1, wherein the funnel portion comprises:

a communication part for communication with the bent pipe portion;

a supply hole for supplying received molten magnesium to the injection sleeve; and a lower part extending between the communication part and the supply hole, the lower part having an inside surface gradually reduced in diameter and smoothly bent between the communication part and the supply hole.

4. A molten magnesium supply system according to claim 3, wherein the supply hole is provided with a shutter therefor.

5. A molten magnesium supply system according to claim 3, wherein the funnel portion is formed with an upper opening and provided with a lid for closing the upper opening.

6. A molten magnesium supply system according to claim 4, wherein the funnel portion is formed with an upper opening and provided with a lid for closing the upper opening.

7. A molten magnesium supply system according to claim 1, wherein the gas supply means comprises:

a first gas supply line for supplying an inert gas as the anti-oxidization gas;

a second gas supply line for supplying a sulfur hexafluoride dilute antideflagrant gas as the anti-oxidization gas; and control means for supplying a vacant space of the funnel portion with the inert gas when the melt level control to the molten metal furnace is on, and with the sulfur hexafluoride dilute antideflagrant gas when the melt level control is off.

8. A molten magnesium supply system according to claim 7, wherein the control means comprises a control valve operative with a control command for the melt level control.

9. A molten magnesium supply system according to claim 1, wherein the molten metal transferring means comprises a volume replacement transfer mechanism.

10. A molten magnesium supply system according to claim 1, wherein the molten metal transferring means comprises a fluid streaming transfer mechanism.

11. A molten magnesium supply system according to claim 10, wherein the fluid streaming transfer mechanism comprise an electromagnetic pump installed on the molten metal transfer pipe.

12. A molten magnesium supply system according to claim 1, wherein the molten metal furnace comprises a melting and holding furnace including a crucible member provided with a melting chamber heated for melting magnesium, and a holding chamber heated for holding molten magnesium, the melting chamber communicating with the holding chamber at a bottom region of the crucible member deeper in the melting chamber than in the holding chamber, the holding chamber communicating with the one end of the molten metal transfer pipe.

13. A molten magnesium supply system according to claim 12, wherein the melting and holding furnace further includes a tilting mechanism for tilting the crucible member together with the molten metal transfer pipe.

14. A molten magnesium supply system according to claim 12, wherein the melting chamber has a round bottom, and the holding chamber has a flat bottom.

15. A molten magnesium supply system according to claim 12, wherein the melting and holding furnace further includes a gas burner for heating the melting chamber, and an electric heater for heating the holding chamber.

16. A molten magnesium supply system according to claim 1, wherein the molten metal furnace comprises a melting and holding furnace for melting a preheated magnesium ingot and holding molten magnesium, and the molten magnesium supply system further comprises ingot charging means for charging the preheated magnesium ingot into the melting and holding furnace, keeping the preheated magnesium ingot substantially free from contact with air.

17. A molten magnesium supply system according to claim 16, wherein the molten magnesium supply system further comprises a preheater for preheating a magnesium ingot to provide the preheated magnesium ingot in an oxidant-free atmosphere, and the ingot charging means is adapted for discharging the preheated magnesium ingot from the preheater, keeping the preheated magnesium ingot substantially free from contact with air.

18. A molten magnesium supply system according to claim 17, wherein the ingot charging means is adapted for carrying the preheated magnesium ingot between the preheater and the melting and holding furnace, keeping the preheated magnesium ingot substantially free from contact with air.

19. A molten magnesium supply system according to claim 18, wherein the ingot charging means comprises:

a chuck for chucking the preheated magnesium ingot;

a carrier for carrying the chuck;

a hood for covering the chuck and the preheated magnesium ingot; and gas supply means for supplying an anti-oxidization gas inside the hood.

20. A molten magnesium supply system including:

a molten metal furnace put under a melt level control;

a molten magnesium supplying apparatus comprising a molten metal transfer pipe communicating at one end thereof with the molten metal furnace, the molten metal transfer pipe having at another end thereof an ascending bent pipe portion as a delivery portion for delivery of molten magnesium to be supplied to an injection sleeve, and molten metal transferring means for forcing molten magnesium from the molten metal furnace to be transferred in the molten metal transfer pipe and delivered through the delivery portion; and gas supplying means for supplying an anti-oxidization gas to vacant spaces in the molten metal furnace and the molten metal transfer pipe, wherein the bent pipe portion is reduced to have a throttle part.

* * * * *